US005576807A

United States Patent [19]

Osawa et al.

[11] Patent Number: 5,576,807

[45] Date of Patent: Nov. 19, 1996

[54] IMAGE FORMING APPARATUS HAVING A CONTACT TYPE CHARGING DEVICE

[75] Inventors: Izumi Osawa, Ikeda; Kazuko Taniguchi, Takatsuki; Masashi Yamamoto, Settsu, all of Japan

[73] Assignee: Minolta Co., Ltd., Osaka, Japan

[21] Appl. No.: 554,268

[22] Filed: Nov. 6, 1995

[30] Foreign Application Priority Data

Nov. 7, 1994 [JP] Japan ..... 6-272390

[51] Int. Cl.[6] ..... G03G 15/02

[52] U.S. Cl. ..... 355/219; 361/255; 361/230

[58] Field of Search ..... 355/219; 361/225, 361/230, 214

[56] References Cited

U.S. PATENT DOCUMENTS

| | | | |
|---|---|---|---|
| 4,455,078 | 6/1984 | Mukai et al. | 355/219 |
| 4,555,171 | 11/1985 | Clouthier et al. | 361/225 X |
| 4,706,320 | 11/1987 | Swift | 355/219 X |
| 5,220,481 | 6/1993 | Swift et al. | 361/225 |
| 5,225,878 | 7/1993 | Asano et al. | 355/219 |
| 5,241,342 | 8/1993 | Asano et al. | 355/219 |
| 5,245,386 | 9/1993 | Asano et al. | 355/219 |
| 5,289,234 | 2/1994 | Asano et al. | 355/219 |
| 5,398,102 | 3/1995 | Wada et al. | 355/219 |

FOREIGN PATENT DOCUMENTS

| | | |
|---|---|---|
| 57-46265 | 3/1982 | Japan . |
| 61-57956 | 3/1986 | Japan . |
| 63-9233 | 2/1988 | Japan . |
| 5-119579 | 5/1993 | Japan . |
| 0098534 | 4/1995 | Japan . |

*Primary Examiner*—Matthew S. Smith
*Attorney, Agent, or Firm*—Brinks Hofer Gilson & Lione

[57] ABSTRACT

An image forming apparatus having a rotatable photosensitive member a charging device for charging a surface of the photosensitive member prior to forming an electrophotographic latent image and a power source for applying a charge voltage which includes at least AC component to the charging device. The charging device includes a rotatable brush member which is formed by implanting piles formed by brush fibers on a base member and provided in contact with the photosensitive member. The photosensitive member and charging device and power source are provided to satisfy the following condition:

$$V_D = K|f_{AC} - f_p| (0 < K \leqq 3),$$

wherein $V_D$ is a moving speed of the surface of said photosensitive member, K is a constant, $f_{AC}$ is frequency of the AC component and fp is a pile frequency which is represented by $V_B/d$ ($V_B$ is the moving speed of the base material and d is a pile pitch).

6 Claims, 16 Drawing Sheets

IMAGE FORMING APPARATUS HAVING A CONTACT TYPE CHARGING DEVICE

BACKGROUND OF THE INVENTION

1. Field of the Invention

This invention relates to an electrophotographic image forming apparatus such as a copying machine and a printer, and more particularly, to an image forming apparatus that accomplishes electrical charging by a contact type charging device.

2. Description of the Related Art

Conventionally, in an image forming apparatus utilizing an electrophotographic method such as a copying machine and a printer, the photoreceptor is charged by a charging device and an electrostatic latent image is formed by image exposure in that charged region. This latent image is developed, made a visible image and then transferred to the transfer member and fixed.

Although various types of charging devices have been known, if broadly classified, they can be divided into corona charging devices which utilize corona discharge and contact type charging devices which force fixed type charging brushes, rotational roller type brushes, endless belt type brushes, and rotational rollers, etc. to make contact with the surface of the photoreceptor.

Though the charging devices which utilize corona discharge have an advantage such that stable charging can be carried out, problems exist in which large amounts of ozone generate while corona discharging is carried out with this causing the photoreceptor to deteriorate as well as having harmful effects on human bodies. Thus, contact type charging devices which generate remarkably low amounts of ozone compared to the amounts of ozone generated by corona charging devices are attracting attention.

Even among these contact type charging devices, in particular, charging devices utilizing a rotational brush are attracting attention from the viewpoint of stable charging.

Furthermore, using a voltage that includes an AC component for charging voltage applied to the charging device is attracting attention from the viewpoint of stabilizing the charging without being affected by variations in the environment. For example, Japanese Laid-open Patent Application No. 63-9233 discloses the application of a voltage to a charging roller in which an AC voltage is superimposed on a DC voltage.

According to the above conventional art, from both viewpoints of suppressing ozone gas and stabilizing the charge, using a rotational brush as the charging member and a voltage which includes an AC component as the charging voltage is preferable.

However, according to the research of the inventors of this invention, in a laser printer with a resolution of, for instance, 400 dpi, 600 dpi or an even higher resolution, if a shading pattern image (also called half image) is formed utilizing a rotational brush as the charging member and utilizing a voltage that superimposes an AC voltage on a DC voltage as the charging voltage, moire-shaped image noise will appear in the formed image.

The moire-shaped image noise stated here is such an image noise that a band shaped portion which seems to have dark image density repeatedly appears. FIG. 20 shows one example of this. The image noise shown in FIG. 20 is image noise in which dots in a certain range fatly developed when a shading pattern image like the one shown in FIG. 19 is formed utilizing a rotational roller-type brush as the charging member and utilizing a voltage that superimposes an AC voltage on a DC voltage as the charging voltage in a laser printer, and the collection of these fat developed dots seem darkly in a band shape as a whole and this band-shaped portion N repeatedly appears.

This type of moire-shaped image noise is not comparatively noticeable at a low resolution of, for example, 240 dpi but becomes more noticeable as the resolution increases. This problem must be solved with today's increasingly higher resolution images.

SUMMARY OF THE INVENTION

The principal object of this invention is to provide an image forming apparatus without image noise that also ensures a stable charge.

Another object of this invention is to provide an apparatus that suppresses image noise even when a high-resolution image is formed.

Another object of this invention is to provide an image forming apparatus which utilizes a rotational brush charging device and a voltage including an AC component as the charging voltage, and further suppresses the generation of moire-shaped image noise.

These and other objects of the present invention is accoplished by an image forming apparatus comprising a rotatable photosensitive member, a charging device for charging a surface of the photosensitive member prior to forming an electrophotographic latent image, the charging device including a rotatable brush member which is formed by implanting piles formed by brush fibers on a base member and provided in contact with the photosensitive member, a power source for applying a charge voltage which includes at least AC component to said charging device, wherein said photosensitive member and charging device and power source are provided to satisfy the following condition:

$$V_D=K|f_{AC}-fp|(0<K\leqq 3)$$

wherein $V_D$ is a moving speed of the surface of said photosensitive member, K is a constant, $f_{Ac}$ is frequency of the AC component and fp is a pile frequency which is represented by $V_B/d$, wherein $V_B$ is the moving speed of the base material and d is a pile pitch.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 4 (A) shows a construction in which pile woven into base cloth, FIG. 4 (B) shows pile woven into synthetic resin base material, FIG. 4 (C) shows a construction with pile woven into a twisted fiber material or a core material.

FIG. 5 (A) is a schematic cross-sectional diagram of this brush member and FIG. 5 (B) is a schematic plane view of this brush member.

FIG. 6 (A) is a schematic cross-sectional diagram of this brush member and FIG. 6 (B) is a schematic plabe view of this brush member.

FIG. 18 (A) shows forward rotation and FIG. 18 (B) shows counter rotation.

DETAILED DESCRIPTION OF THE PREFERRED EMBODIMENTS

Figure 1:
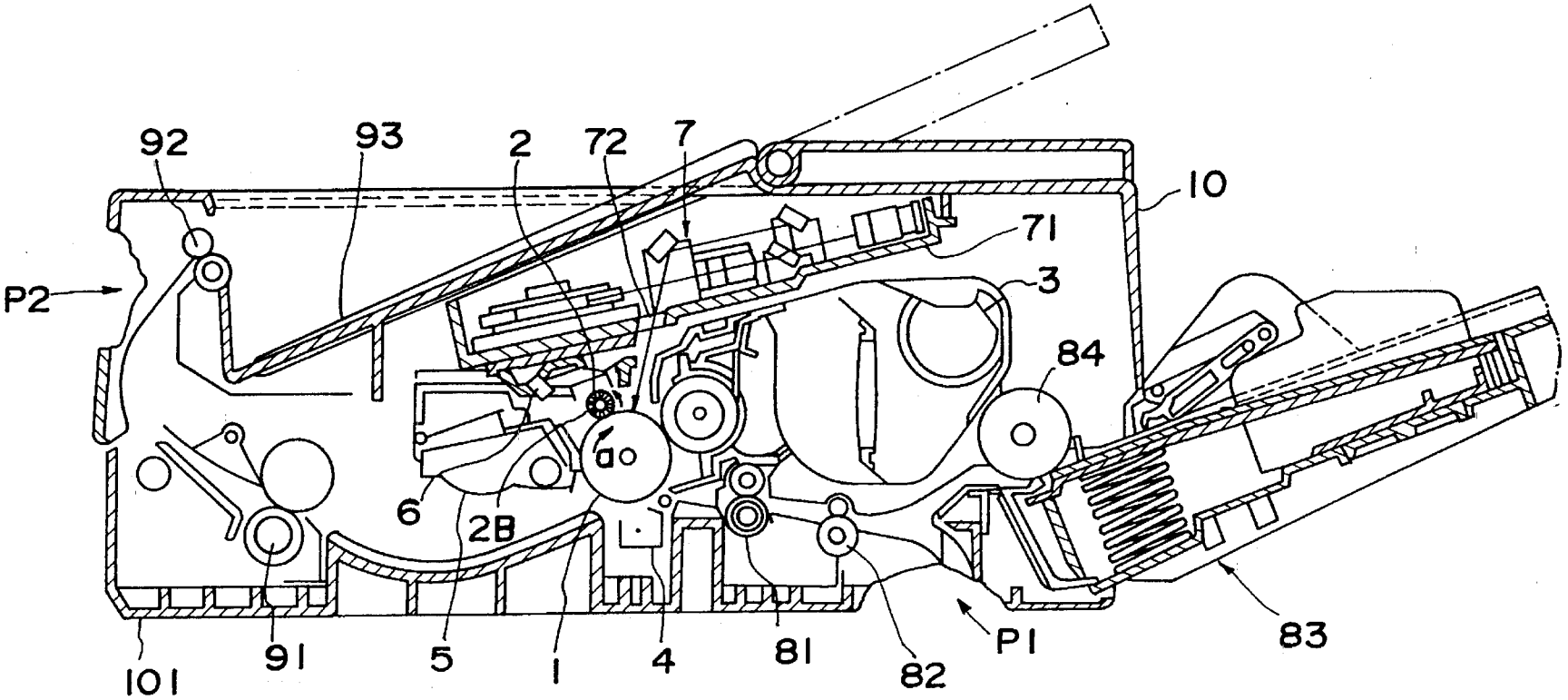
FIG. 1 shows a schematic construction of the main parts of the laser printer of one embodiment of this invention.

Referring now to the drawings, an image forming apparatus according to one preferred embodiment of the present invention will be described.

At first, each element in the image forming apparatus of this invention will be described.

(1) Construction and material of the brush member

Many different variations can be conceived for the construction of the brush member although, from the viewpoint of preferable strength, producability and fiber implantation density, a material with identical construction of a velvet weave can be presented as a representative example. Namely, as shown in FIG. 4 (A), BM1 in which a plurarity of pile P comprising brush fibers are woven into base cloth B1 as a base material at equal spacing.

Figure 4:
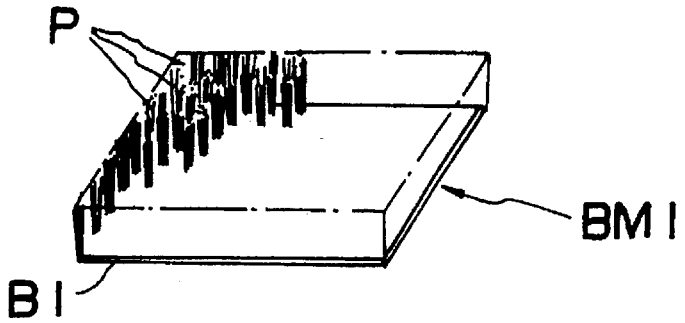
FIG. 4 shows construction examples of a brush utilized in the charging device.
Figure 4:
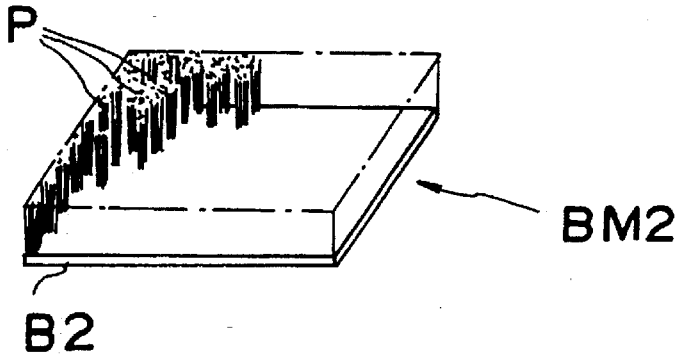
Figure 4C:
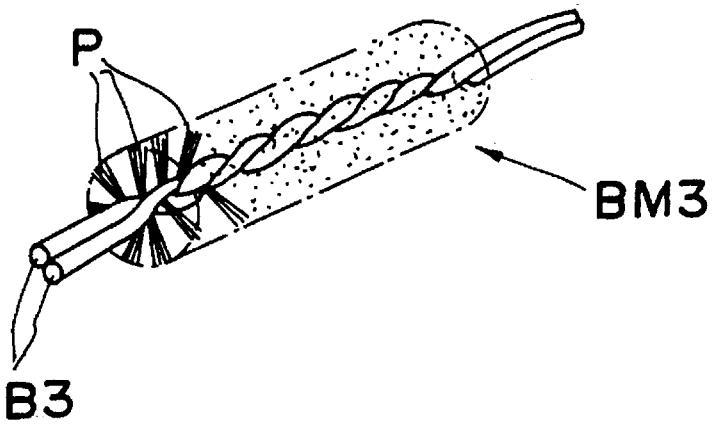

In addition, other possible considerations are, as shown in FIG. 4 (B), BM2 in which a plurarity of pile P comprising brush fibers are implanted into a flexble sheet-shaped synthetic resin base material B2 at equal spacing and, as shown in FIG. 4 (C), BM3 in which a plurality of pile P comprising brush fibers are implanted by insertion in a base material B3 formed by either two strands of twisted wire or a cylinder material with certain intervals. This invention can also be applied to another type of brush members as far as pile is implanted at a regulated pitch.

In either case, each pile is typically considered as groupings of 20~200 brush fibers each of which has a diameter of about 10 μm.

Figure 5A:
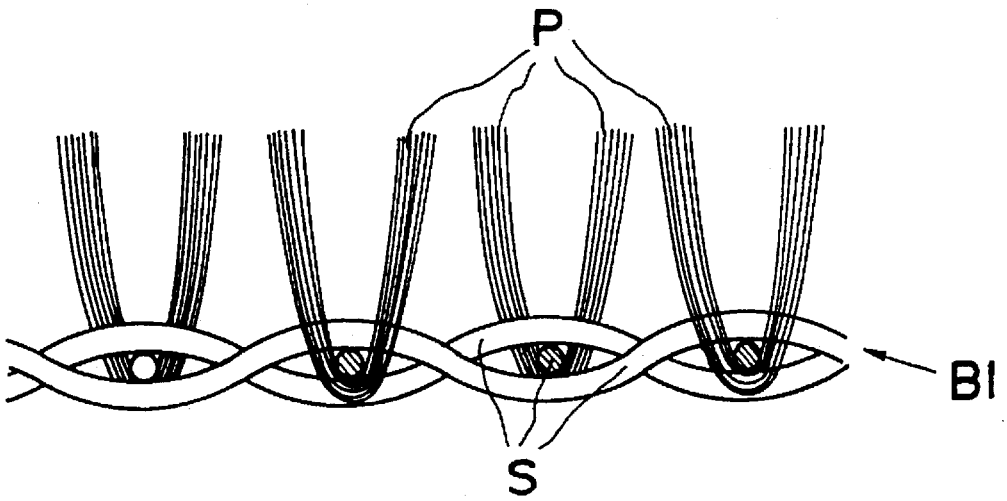
FIG. 5 shows an example of a woven V-shaped pile into a base cloth in the brush member as shown in FIG. 4 (A)
Figure 5B:
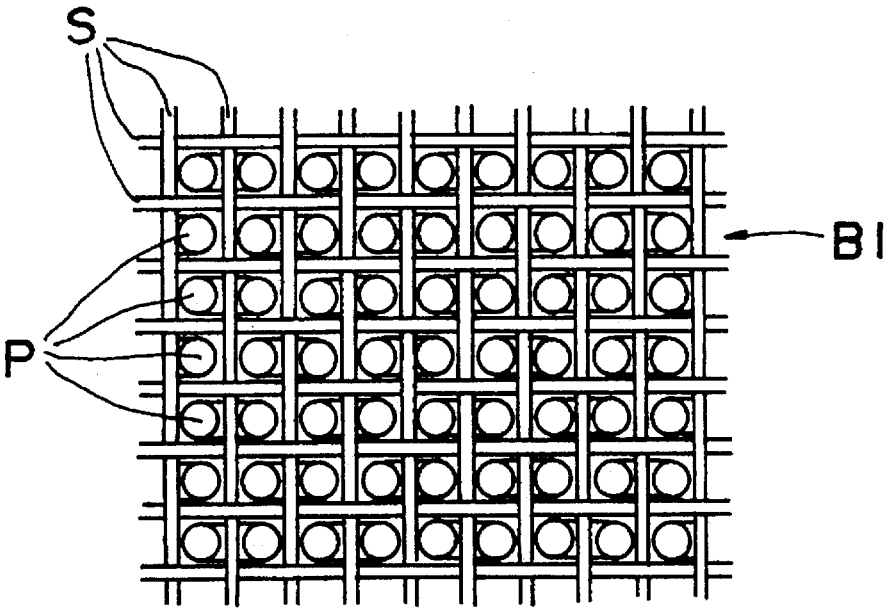
Figure 6:
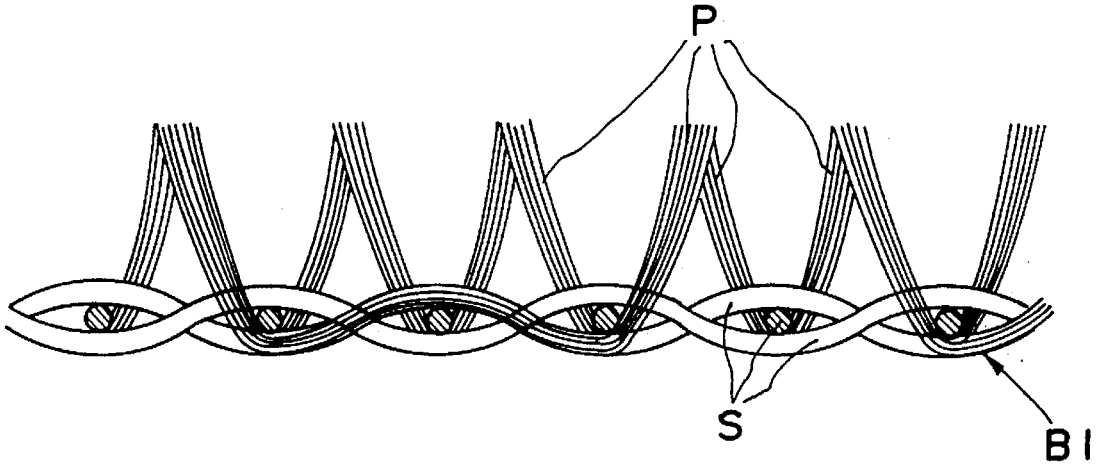
FIG. 6 shows an example of a woven W-shaped pile into a base cloth in the brush member as shown in FIG. 4 (A)
Figure 6:
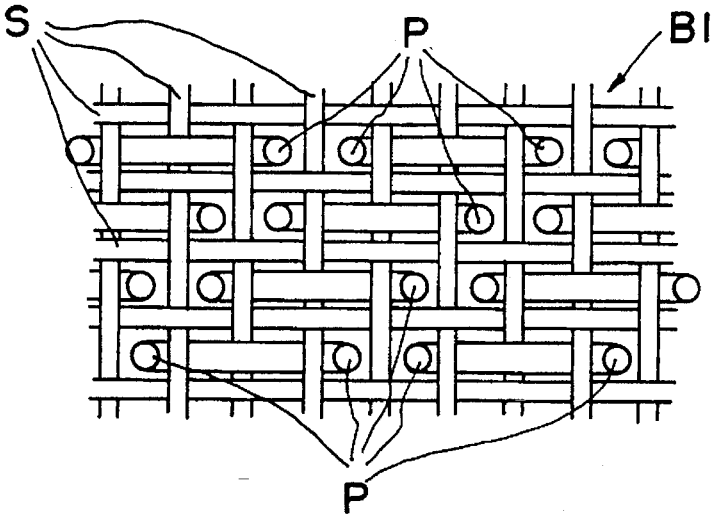
Figure 7A:
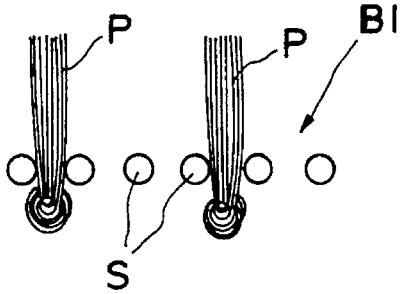
FIG. 7 (A), FIG. 7 (B), FIG. 7 (C), FIG. 7 (D), FIG. 7 (E) and FIG. 7 (F) each show other examples of the weaving method of the pile into base cloth in the brush as shown in FIG. 4 (A).
Figure 7D:
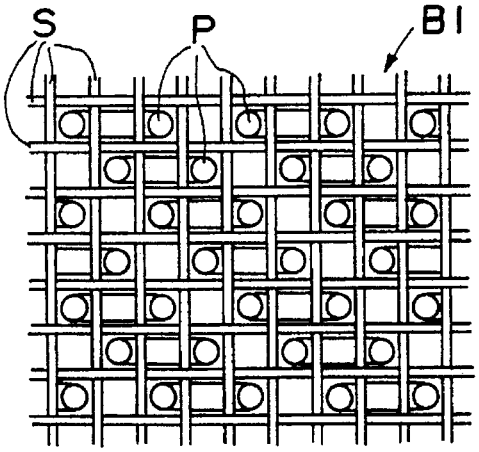
Figure 7B:
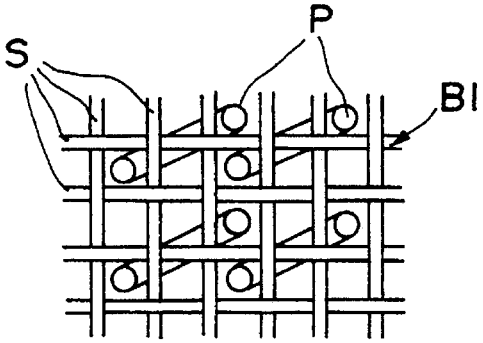
Figure 7E:
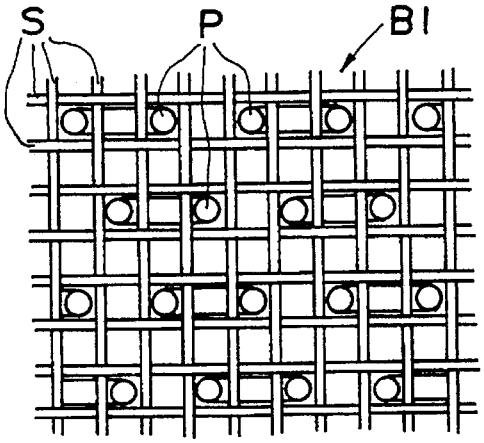
Figure 7C:
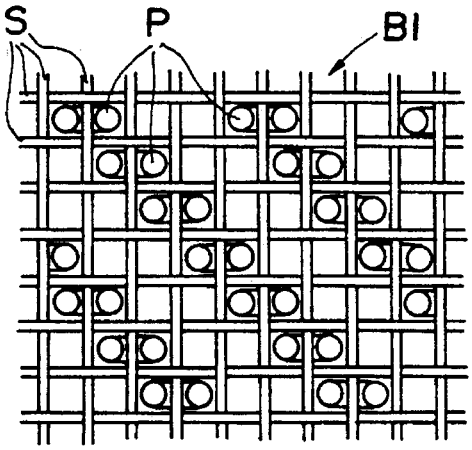
Figure 7F:
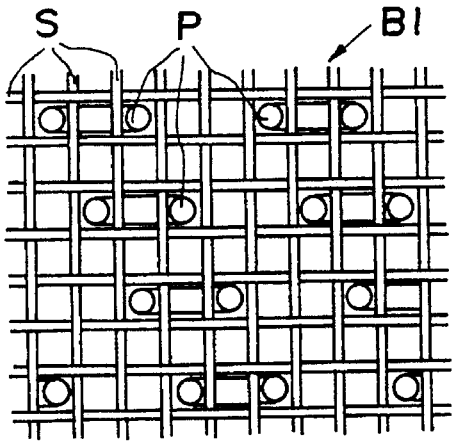

As representative examples of the weaving method of the pile P into the base cloth B1 when utilizing brush member BM1 shown in FIG. 4 (A), as shown in FIG. 5, each pile P can be woven in a V-shape in fiber S forming base cloth B1 or, in other words, a V-shaped weave. Also, as shown in FIG. 6, each pile P can be woven in a W-shape in fiber S forming base cloth B1 or, in other words, a W-shaped weave. It is more difficult for brush fibers to fall out from the W-shaped weave than from the V-shaped weave.

Furthermore, as a special weaving method as shown in FIG. 7 (A), it is conceivable to insert each pile P against the base cloth B1 and then tie this pile in a square knot at the rear side of the base cloth.

Even further, as a variation example (in which the pile pitch is changed) of the V-shaped weave and W-shaped weave shown in FIG. 5 and FIG. 6, the weaving methods shown in FIG. 7 (B) to (F) are also conceivable.

The example shown in FIG. 7 (B) is a weaving method without a parallel relationship between the base cloth fiber S and the pile P making the producability poor. However, when carrying out a coating process on the rear surface of the base cloth, the flow of the coating solution passing through the fiber holes becomes complicated, which make it easier to have an even coating. The example shown in FIG. 7 (C) is a weaving method in which pile P is thinned out in the V-shaped weave shown in FIG. 5. The example shown in FIG. 7 (D) is a weaving method in which the fiber holes of base cloth fiber S into which pile P is stuck during the V-shaped weaving in the weaving method of FIG. 7 (C) are increased. The example shown in FIG. 7 (E) is a weaving method in which pile P is thinned out in the vertical direction compared to FIG. 7 (D). The example shown in FIG. 7 (F) is a weaving method in which spaces between the fiber holes into which pile P is stuck and the fiber holes of the V-shaped weaving are changed compared to FIG. 7 (E).

Moreover, in addition to these, the pile pitch can be changed using various methods such as intermingling different weaving methods, changing the fiber diameter of the base cloth, intermingling different diameters of the pile.

For the material of the brush fiber, it is preferable to suitably choose a material with a favorable electrical resistance ratio, softness, hardness, shape and strength in order to apply a voltage including an AC component to obtain the desired charge quantity while considering the photoreceptor charging capacity, photoreceptor surface hardness, photoreceptor diameter and positioning relationship with other elements of the rotational brush as well as the system speed. There are no special limitations on the material.

For a brush fiber material with conductive properties, metal fibers such as tungsten, stainless steel, gold, platinum, aluminum, iron, or copper can be used while adjusting them for a suitable length or fiber diameter.

For the brush fiber material with conductive resin, a material can be used in which a resistance adjustment agent is dispersed such as carbon black, carbon fiber, metal powder, metal whiskers, metal oxide and semiconductor material within a fiber comprising rayon, polyamide, cuprammonium, vinylidene, ethylene fluoride, benzoate, polyurethane, polyester, polyethylene, vinyl chloride and polypropylene. In this case, a suitable and desired resistance value can be obtained depending on the dispersion quantity. Moreover, a resistance adjustment agent may cover the fiber surface without any dispersal.

The electrical resistance ratio of this type of fiber material is normally set to a volume resistivity of about $10^9$ Ωcm or less and, more preferably, $10^7$ Ωcm or less in order to obtain favorable charging performance.

Further, the cross-sectional shape of the fiber material can be circular, elliptical, circular with a wrinkled periphery, polygonal, flat or a shape having a cavity inside and other shapes which are easy to manufacture.

(2) Support and rotation of the brush member ,

For BM3 shown in FIG. 4 (C), base matirial B3 can be rotatably supported on a suitable material to drivingly rotate and bring the pile P into contact with the surface of the photoreceptor. For this case, the base material B3 can be formed by a conductive metal, a conductive synthetic resin or an insulation material whose surface underwent conductive processing.

Figure 8:
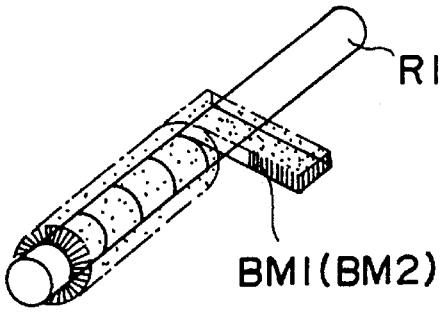
FIG. 8 (A), FIG. 8 (B), FIG. 8 (C), FIG. 8(D) and FIG. 8 (E) each show an example of how to form the type of brush member as shown in FIG. 4 (A) and FIG. 4 (B) into a rotational brush member.
Figure 8:
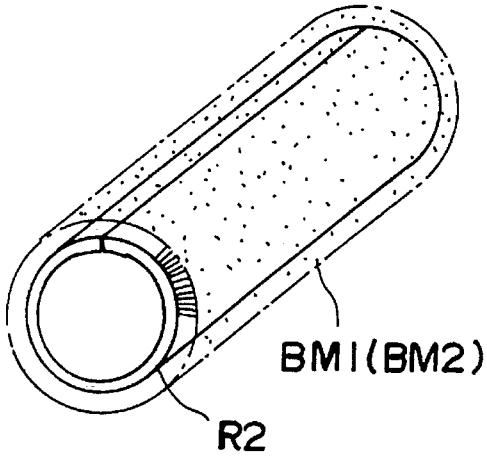
Figure 8B:
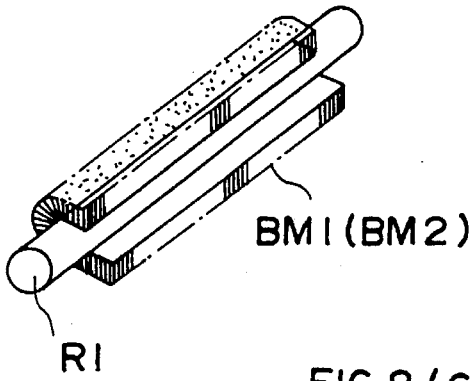
Figure 8E:
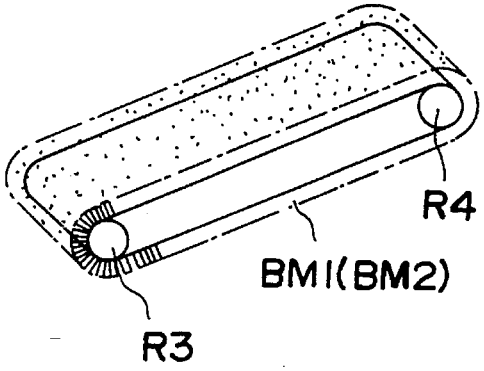
Figure 8:
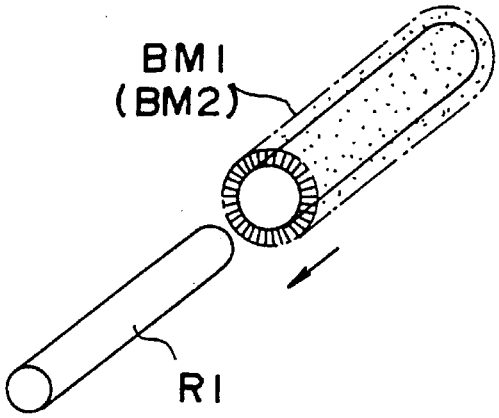

Moreover, for example, it is also conceivable for the brush bodies BM1 and BM2 shown in FIG. 4 (A) and (B) to be spirally wound as shown in FIG. 8 (A), to be flatly wound as shown in FIG. 8 (B), to be cylindrically formed and inserted beforehand, and then adhered using electrical adhesive agent on the surface of a rotatably driven conductive core R1 comprised by either a conductive metal or a conductive synthetic resin, or an insulation material whose surface underwent conductive processing. Also, as shown in FIG. 8 (D), it is conceivable to make a conductive plate-like member R2 made by conductive metal, a conductive synthetic resin or an insulation material whose surface underwent conductive processing form a cylindrical shape, and to sandwich the edge portion of the brush member between facing edges of the plate-like memeber and caulke it and then rotate them. During this time also, the brush member can be adhered using conductive adhesive agent. Furthermore, as shown in FIG. 8 (E), it is conceivable to wind the brush member formed in an endless belt shape in advance on pulleys R3 and R4, at least one of which is driven to rotate or at least one of which has conductive properties comprising a conductive metal, a conductive synthetic resin or an insulation material whose surface underwent conductive processing. A rotational brush obtained in this way is then brought into contact with the surface of the photoreceptor PC as illustrated in FIG. 9 (A) to (D).

Figure 9:
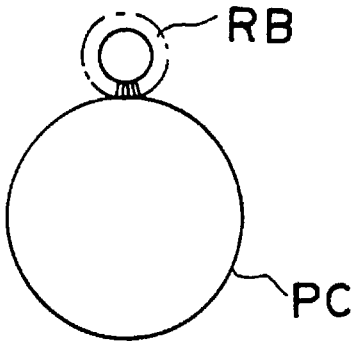
FIG. 9 (A), FIG. 9 (B), FIG. 9 (C) and FIG. 9 (D) each show examples of states in which the rotational brush member shown in FIG. 8 is brought into contact with the photoreceptor.
Figure 9:
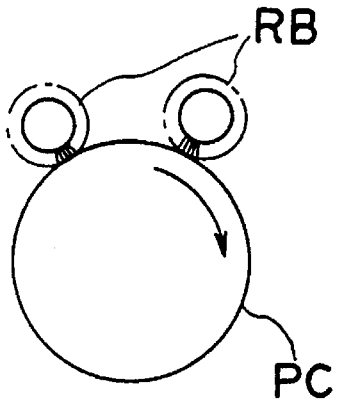
Figure 9:
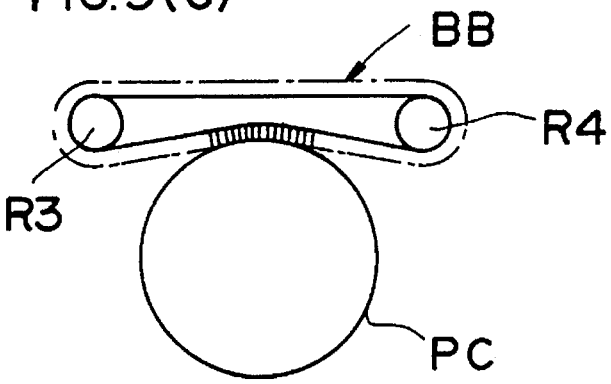
Figure 9:
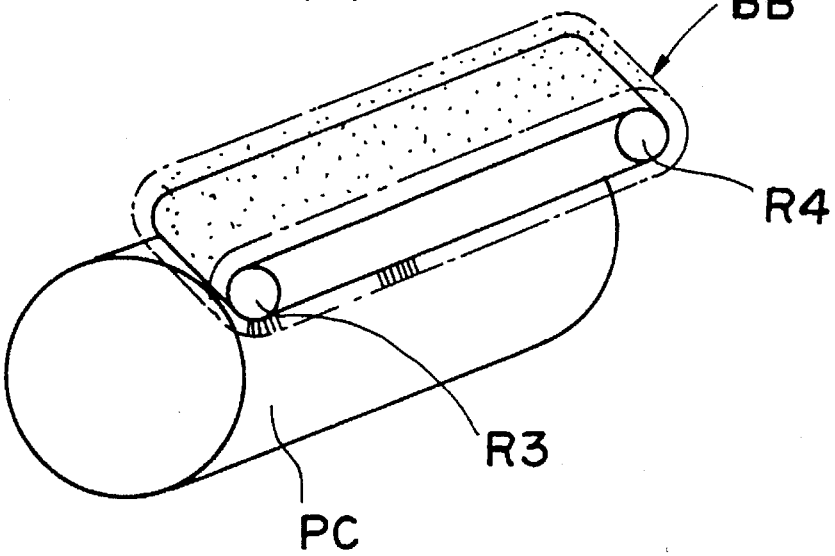

FIG. 9 (A) shows a state in which one roller shaped rotational brush RB is brought into contact with the photoreceptor. FIG. 9 (B) shows a state in which two roller shaped rotational brushes RB are brought into contact with the photoreceptor. The present invention should be applied to the lowest downstream brush in the movement direction of the surface of the photoreceptor when bringing a plurality of rotational brushes into contact with the photoreceptor in this way, Furthermore, FIG. 9 (C) shows a state in which a belt shaped rotational brush BB is brought into contact with the photoreceptor and the line connecting pulleys R3 and R4 which support the brush is arranged at a right angle relative to the drum type photoreceptor rotating axis. FIG. 9 (D) shows a state in which a belt shaped rotational brush BB is brought into contact with the photoreceptor and the line connecting pulleys R3 and R4 which support the brush is arranged parallel to the drum type photoreceptor rotating axis. The present invention can be applied to any of these.

(3) Pile frequency fp and pile pitch (pile implantation pitch) d Even though the rotational brush is either a roller type or a belt type, the idea behind the each is identical for the pile frequency $f_p$. For example, as shown in FIG. 10 (A), when the roller type rotational brush RB makes contact with the surface of the photoreceptor PC or, as shown in FIG. 10 (B), when the belt type rotational brush BB makes contact with the surface of the photoreceptor PC, if the movement speed of the base material into which the pile P of these brushes are implanted is $V_B$ (mm/sec) and the pile pitch is d (mm) then the pile frequency $f_p$, is represented as pile frequency fp (Hz)=$V_B$/d.

Figure 10A:
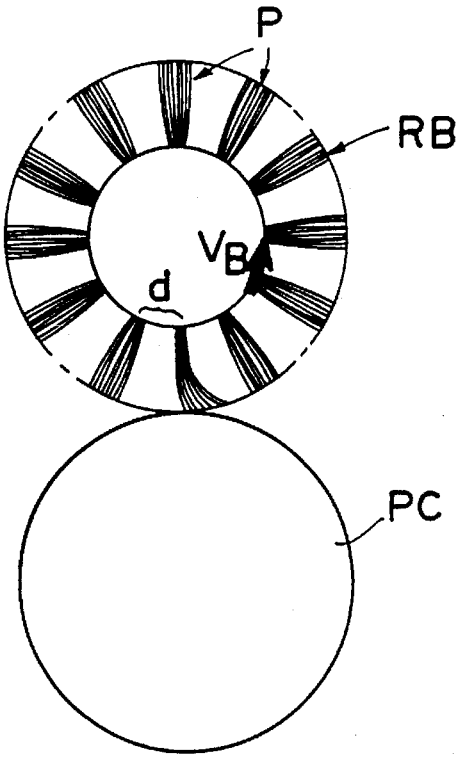
FIG. 10 (A) is a figure that shows the pile frequency in a roller type rotational brush member, FIG. 10 (B) is a figure that shows the pile frequency in a belt type rotational brush member.
Figure 10:
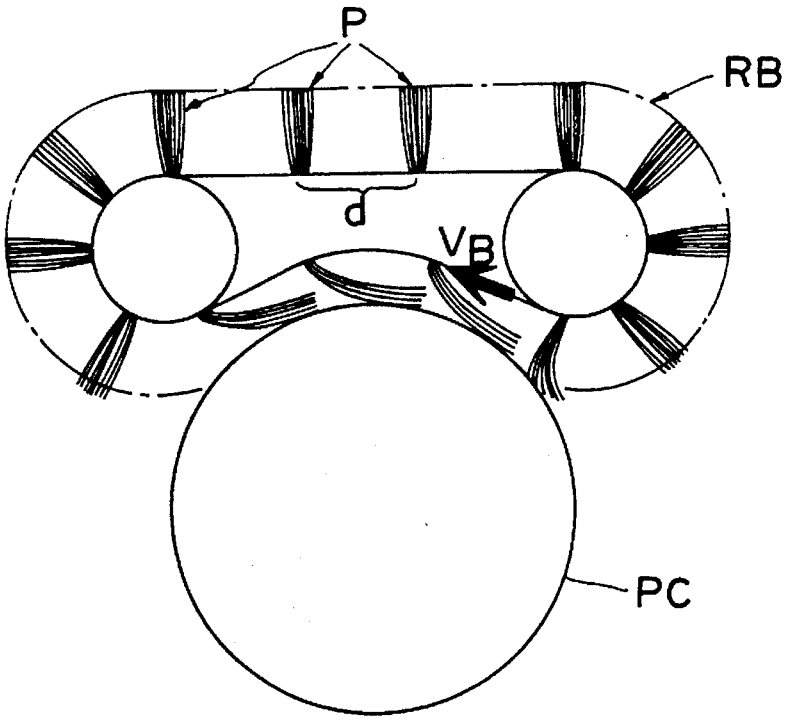

Though, the pile pitch d in FIG. 10 is simply represented, the pile implantation state in an actual brush varies as shown in FIG. 5 to FIG. 7. The method to determine the pile pitch d in this invention will be described hereinafter.

Method to determine d

The method to determine pile pitch d is the same even if a brush member or a rotational brush member is of either type stated above. Therefore, it will be described using a brush member in which pile P is implanted in the base cloth B1 as a representative example as shown in FIG. 4 (A). In either case, pile pitch d is determined in a state that the brush member is flatly expanded.

Figure 11:
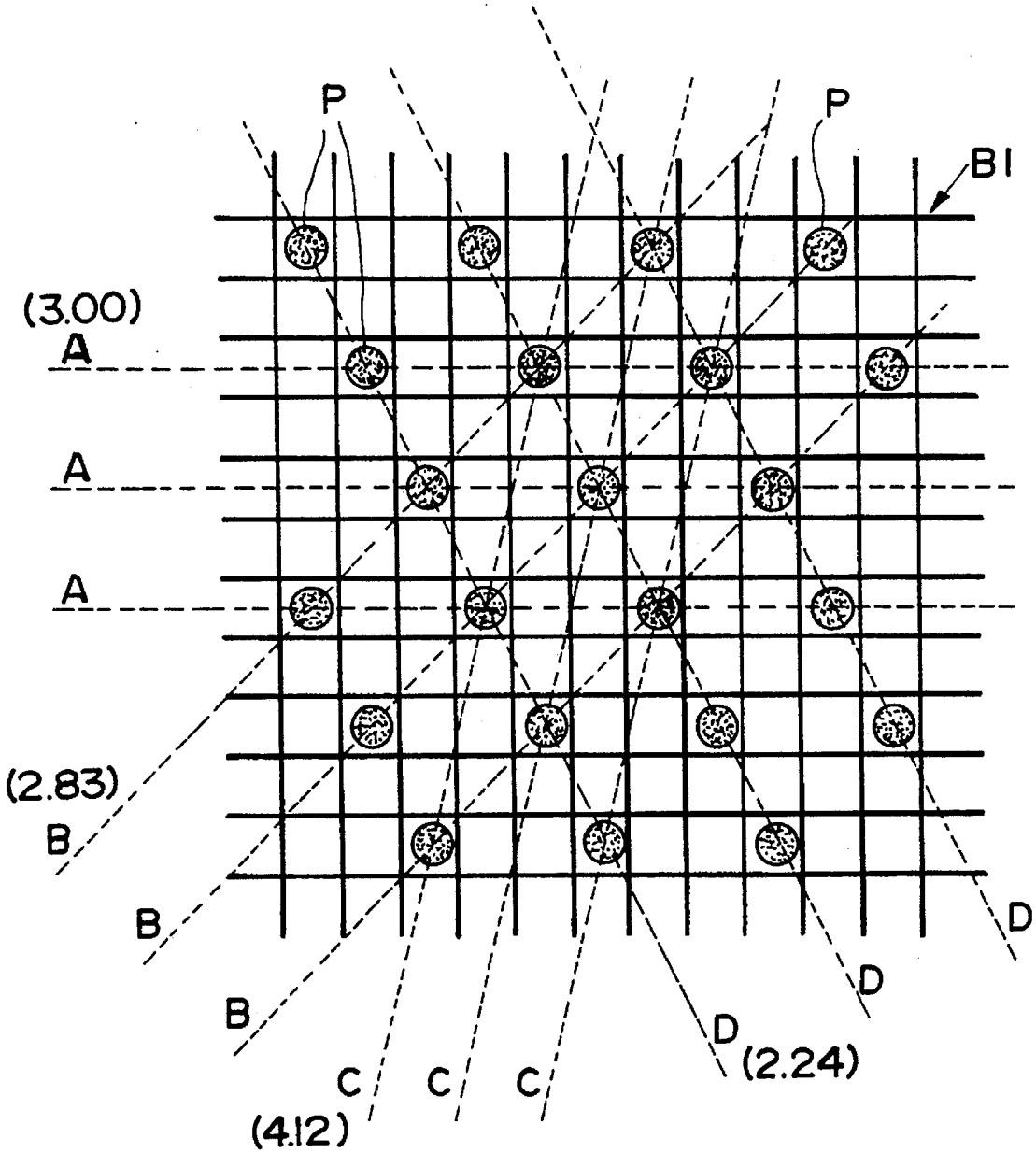
FIG. 11 shows one example of how to obtain the pile pitch of a brush member as well as showing the first step of that process.

FIG. 11 shows one example of an flatly expanded brush member in which pile P is implanted in the base cloth B1 . Each black dot represents a pile P.

In this brush member a plurality of straight line "rows" exist which the pile P forms. The groups of lines indicated by A, B, C, and D in the figure are representative examples of that. To determine the pile pitch d, at first, an appropriate group of lines must be chosen from among these groups. The numbers 3.00, 2.83, 4.12 and 2.24 written inside the ( ) and shown next to the group of lines A, B, C, and D show, when a weave interval of the base cloth B1 is deemed one unit, with how many units as intervals pile P are lined up on each line. For example, A indicates the pile P lines up every 3 units and B indicates the pile P lines up at every $\sqrt{(2^3+2^2)}\div 2.83$ units. From among these groups, the group of lines with the smallest spacing between piles is D lining up every $\sqrt{(2^2+1^2)}\div 2.24$ units. Although various groups of lines also exist other than A, B, C, and D, by examining these four groups, we can easily recognize that other groups of lines will have pile spaces wider than at least D.

In this way, as the first operation to specify d, the group of lines (for this case D) in which the intervals between the piles are the closest is initially chosen.

Figure 12:
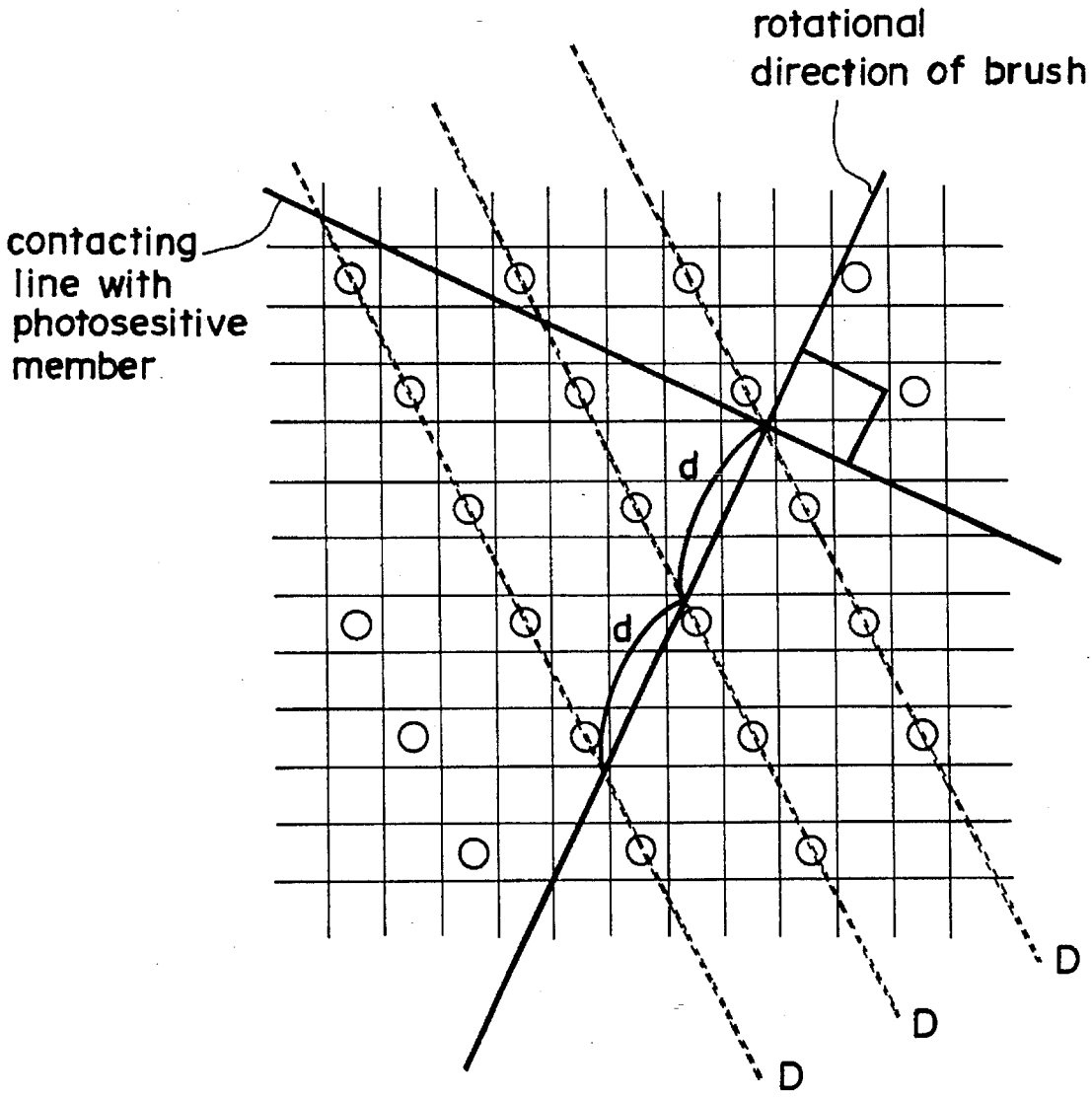
FIG. 12 shows one example of how to obtain the pile pitch of a brush member identical to FIG. 11 as well as showing the second step of that process.

Next, the contact line between the brush member and the photoreceptor as shown in FIG. 12 is obtained in an expanded brush member. This contact line with the photoreceptor becomes slightly shifted with respect to the crosswise relationship of the weave of the pile when, for example, the brush member is spirally wound on the core R1 as shown in FIG. 8 (A). The "contact line with the photoreceptor" in FIG. 12 typically shows a contact line between a brush member and a photoreceptor including that shift caused by using the rotational brush shown in FIG. 8

A vertical line relative to the contact line which was obtained in this way is the rotation direction of the brush member. Pile pitch d which is the intersection between this rotation direction and the group of lines D is pile implantation pitch d which is related to the pile frequency $f_p$,that is the source of moire-shaped image noise generation.

However, depending on the type of pile weave, there is a possibility of confusion with selection method of the said group of lines and the pile pitch (or pile pitch d) which is the intersection pitch between said brush member rotation direction and said group of lines. Therefore, the method to determine the pitch d for this case will be described.

Method to determine d for a confusing case

Figure 13:
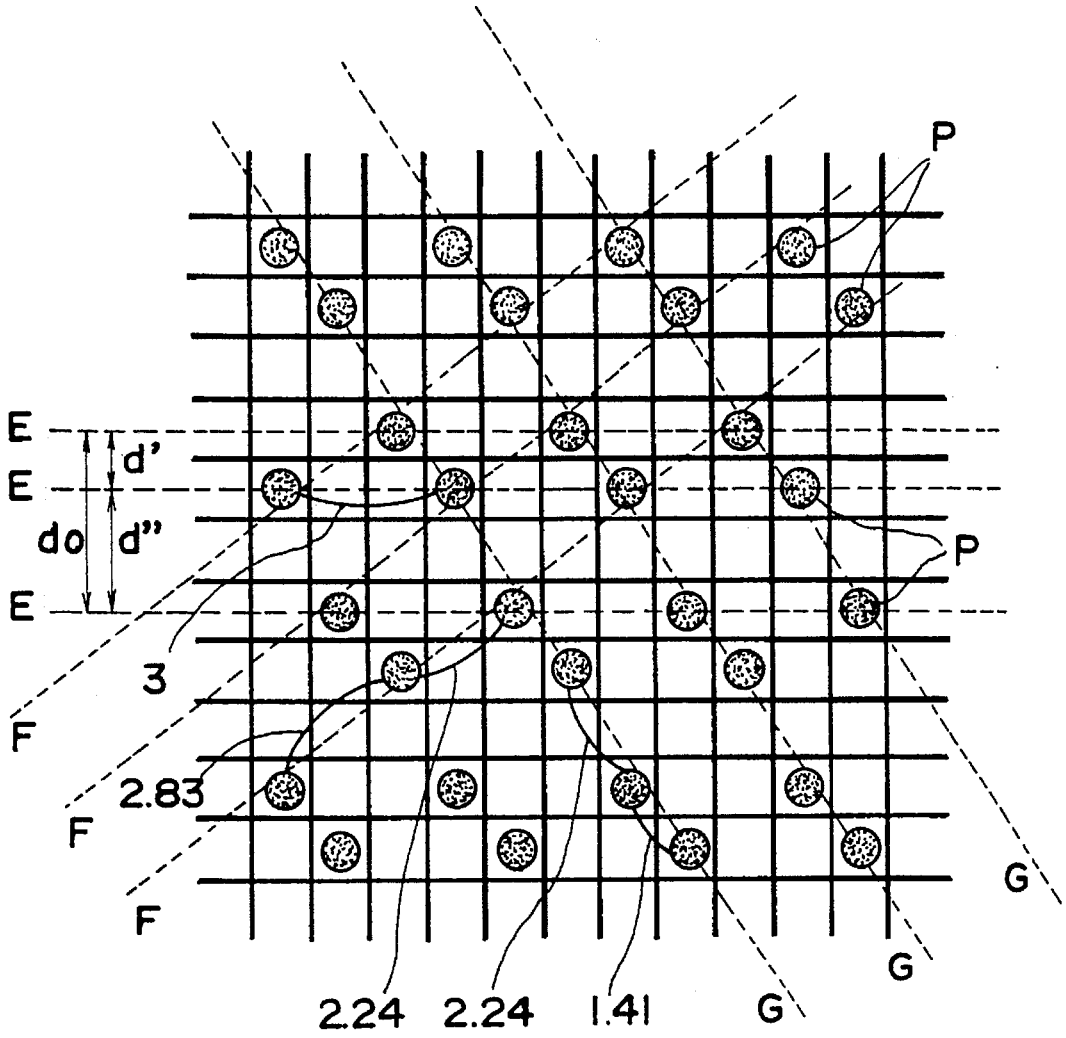
FIG. 13 shows another example of how to obtain the pile pitch of a brush member.
Figure 14:
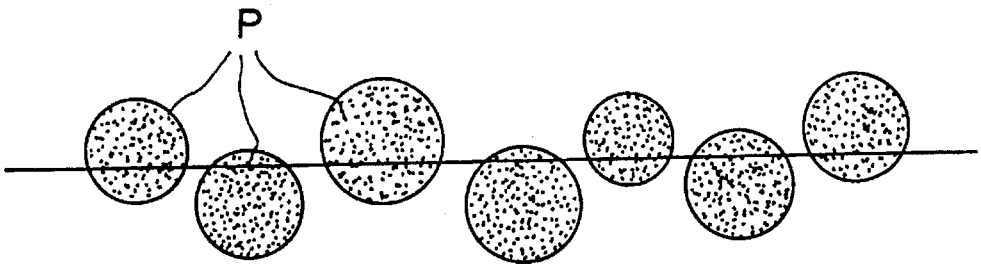
FIG. 14 shows an idea for a straight row of the pile when the pile is not lined up in a completely straight line so as to obtain the pile pitch of a brush member.

To give an example, for the brush member shown in FIG. 13, initially, mistakes will occur to distinguish which pile P is lined up in a straight line. The pile for the group of lines E lines up geometrically correctly in a straight line thus, there is no problem. This, however, does not mean that the pile for groups of lines F and G is lined up completely in a straight line. Nevertheless, the generation of moire-shaped image noise which is a theme in this invention will be sufficiently affected even if the straightness of the line is slightly shifted in this way. Thereupon, pertaining to the straightness of the pile for this case, if at least one straight line is drawn with passing through one portion of the pile, those pile are considered to be lined up in a straight line. In other words, the pile group as shown in FIG. 14 is considered to be lined up in a straight line. The thickness of each pile may different.

Figure 15:
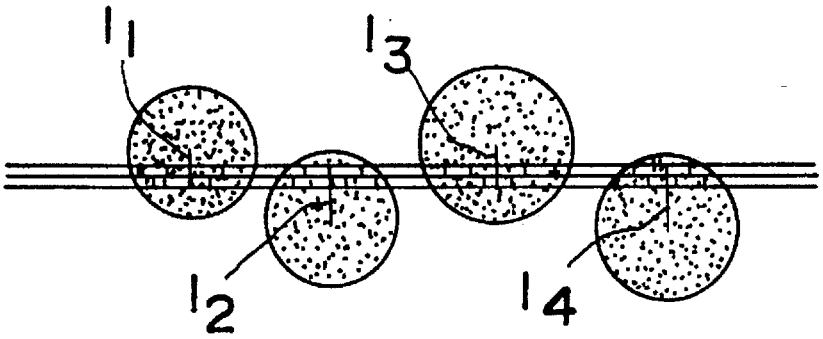
FIG. 15 describes which straight line to choose when a plurality of straight lines passing through the pile are conceivable.

Furthermore, the following procedure is used to uniformly determine the straight line. FIG. 15 shows a case in which a plurality of straight lines are conceivable in the pile row shown in FIG. 14. However, from among the straight lines through which all the pile P can be passed through, choose the one with the smallest square average of distance $\mathbf{1}_1$, $\mathbf{1}_2$, $\mathbf{1}_3$, $\mathbf{1}_4$ —between these straight lines and the center of the pile with regard to all the pile P. In other words, choose one with the smallest value of $\sqrt{(1_1^2+1_2^2+1_3^2+1_4^2—)}$.

Lines E, F, and G in FIG. 13 show lines obtained in this way. Next, which group of lines from among these groups of lines should be used in the discussion of this invention will be described.

The pile in group of lines E lines up every 3 units.

The pile in group of lines F alternately lines up every $\sqrt{(2^2+2^2)}\div 2.83$ units and $\sqrt{(2^2+1^2)}\div 2.24$ units.

The pile in group of lines G alternately lines up every $\sqrt{(2^2+1^2)}\div 2.24$ units and $\sqrt{(1^2+\mathbf{1}^2)}\div 1.41$ units.

When a wide space is included in the pile spaces lining up in one straight line in this way, the continuity of the pile can be easily lost with the meaning of this invention being lost as well. Therefore, for this case, choose the largest one from among the pile spaces lining up in one straight line or, in other words, 3 units for group of lines E, 2.83 units for group of lines F and 2.24 units for group of lines G and even further, choose the lowest unit from among these or, in other words, for group of lines G having 2.24 units.

There is still a possibility of confusion when determining d from among the groups of lines chosen this way. Namely, there is a chance the space of associated lines adjoining each other in the chosen group of lines will be different. For example, this is a case in which the group of lines E in FIG. 13 is temporarily chosen as a group of lines which must be discussed (groups of lines F and G have identical spaces thus no confusion). For group of lines E, neither line space d' nor line space d" generate a regular frequency when the brush member rotates. Line space $d_0$ is the one that generates the regular frequency. Thereupon, for this case in which the group of lines E is chosen as a group of lines which must be discussed, line space $d_0$ shown in FIG. 13 is used as the pile pitch d. (Moreover, the group of lines in FIG. 13 which must be discussed is originally G. This is added for precaution's sake.)

(4) AC component frequency ($f_{AC}$)

Figure 16:
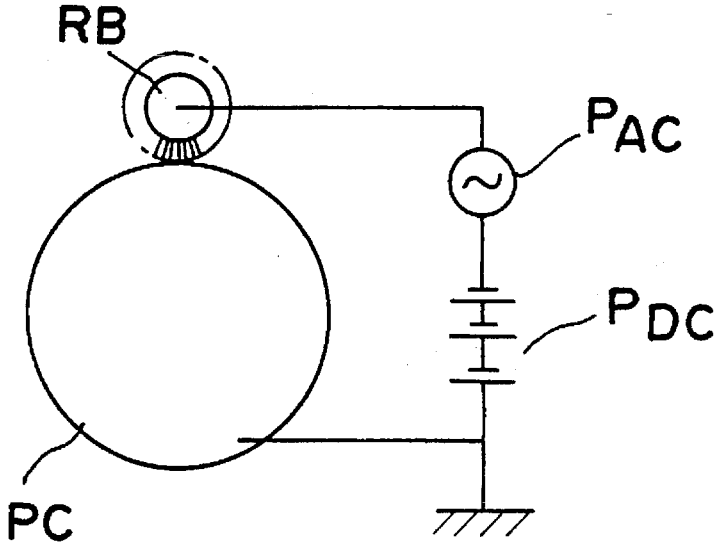
FIG. 16 shows an example of the construction of a power supply suppling charging voltage which superimposes an AC voltage on a DC voltage in a charging device provided with a rotational brush member.

As shown in the example in FIG. 16, for example, using an alternating current (AC) power supply $P_{AC}$ and a direct current (DC) power supply $P_{DC}$, a voltage is applied to the rotational brush with both voltages in a superimposed state in this invention.

As the DC component, for this case, a voltage chosen from a range of approximately 300 to 1500 V is applied with a polarity corresponding to the charge polarity of the photoreceptor.

Further, the AC component is superimposed on the DC component and normally applies an alternating voltage having an amplitude chosen from a range of approximately 500 to 1500 V peak-to-peak.

Needless to say for the peak-to-peak value of the AC component, the frequency can be suitably selected while considering the related resistance value of the rotational brush material, electrostatic capacity of the brush material, contact resistance between the rotational brush and photoreceptor and drive speed of the rotational brush and photoreceptor. Normally, use a frequency chosen from a range of approximately 5 to 5000 Hz.

However, when choosing these values in this invention, choose values which satisfy the conditions of the equation $$V_D=K|f_{AC}-f_p|(0<K\leqq 3)$$

to solve the problem of suppressing the generation of moire-shaped image noise.

Figure 17:
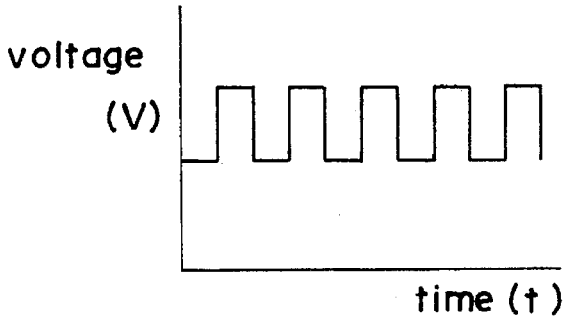
FIG. 17 (A), FIG. 17 (S), FIG. 17 (C), FIG. 17 (D), FIG. 17 (E), FIG. 17 (F), FIG. 17 (G) and FIG. 17 (H) each show an example of a waveform of an AC component applied to a charging device.
Figure 17:
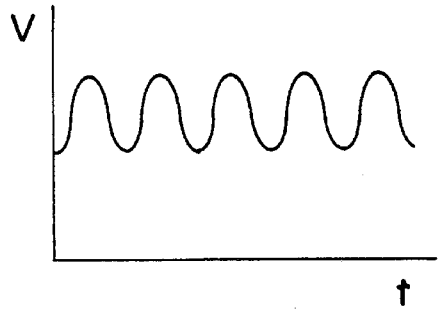
Figure 17:
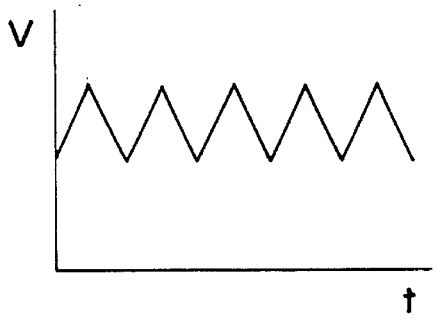
Figure 17:
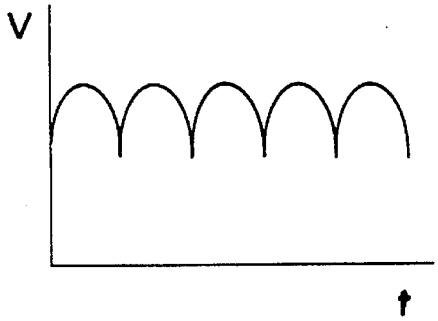
Figure 17:
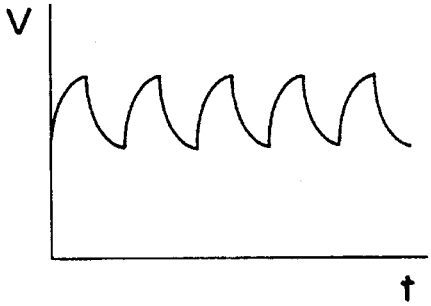
Figure 17:
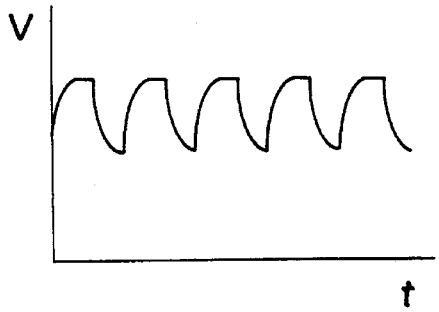
Figure 17:
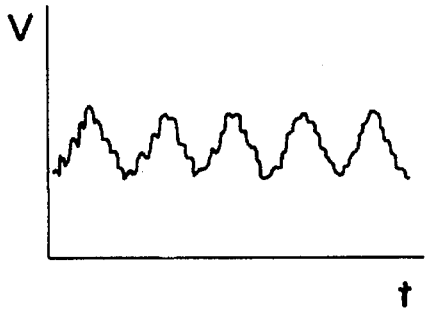
Figure 17:
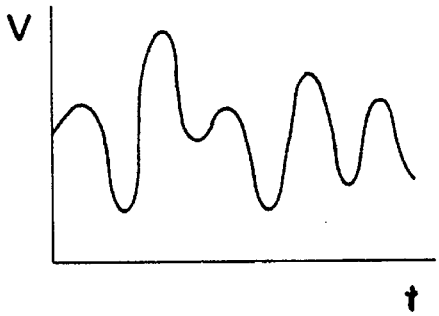

If the conditions above are taken into consideration for the waveform of the AC component, they are not subject to any restrictions in particular, as shown in FIG. 17, they can be illustrated by (A) a recutangular wave, (B) a sine wave, (C) a saw tooth wave, (D) a half sine wave, (E) a saw tooth wave including a time constant, (F) a recutangular wave including a time constant, (G) a waveform with a sub-waveform superimposed on a main waveform and (H) a waveform pulsating peak-to-peak. Moreover, the recutangular wave shown in FIG. 17 (A) can be obtained by controlling the switch between the two DC power supplies having different voltages.

(5) Description of equations

As previously stated, when the pile frequency Fp (Hz) is $V_B$ (mm/sec)/d (mm) and the AC frequency is $F_{AC}$ (Hz), the less a difference between these two becomes, the more noticeable the beats phenomenon will become apparent making it easier for moire-shaped image noise to occur.

Figure 18:
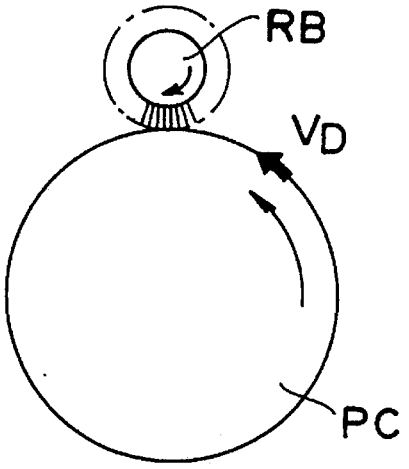
FIG. 18 describes the relationship of the rotation direction of the rotational brush with respect to the movement direction of the surface of the photoreceptor.
Figure 18:
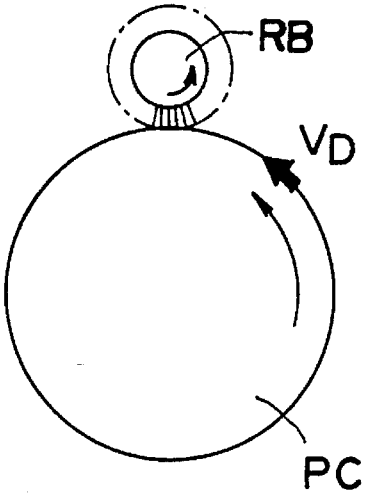

In other words, if $|f_{AC}-f_p|$ becomes too small, moire-shaped image noise will generate. The interval in which the moire-shaped image noise appears on the image (moire pitch) is a pitch in which this beats phenomenon appears as an uneven charge on the surface of the photoreceptor. However, no difference occurs due to the movement direction of the surface of the photoreceptor and the rotation direction of the rotational brush. Namely, as shown in FIG. 18 (A), the rotation direction of the rotational brush relative to the movement direction of the surface of the photoreceptor icludes the following two cases, that is, a rotation in which the contact region of the surfaces of both move in the same direction (forward direction) (hereinafter referred to as "following rotation") and, as shown in FIG. 18 (B), a rotation in which the contact region of the surfaces of both move in opposite directions (counter direction) (hereinafter referred to as "counter rotation"). The moire pitch, however, does not differ in both directions and, for either case, if the relationship of "movement speed on the surface of photoreceptor"

$$V_D=K\,|f_p-f_{AC}|\,(0<K\leqq 3)$$

is satisfied as stated above, the moire-shaped noise can be sufficiently suppressed.

According to the research done by the inventors of this invention, when $0<K\leqq 3$, an image can be obtained without much moire-shaped noise during practical use and when $0<K\leqq 2$, an even more favorable image can be obtained.

A concrete embodiment of the apparatus utilizing this invention will be described.

FIG. 1 shows a schematic construction of the main parts of a laser printer which is one embodiment of this invention. This printer is an altered version of a comparatively low-speed laser printer model SP101 manufactured by Minolta. As a device to charge the photoreceptor drum, a charging device 2 is utilized in which a brush member consisting of a plurality of pile comprised from brush fibers implanted in a base material is made to rotate bringing this pile into contact with the surface of this photoreceptor drum in place of the corona charging device in this printer SP101. This brush member is a velvet type shown in FIG. 4 (A) and the weaving method of the pile P into the base cloth B1 is shown in FIG. 7 (E). Continuing, this brush member as shown in FIG. 8 (A), is spirally wound on rotatable core R1 (manufactured with conductive metals) and then adhered using electrical adhesive agent to form rotational brush 2B. That pile as shown in FIG. 9 (A), is brought into contact with the photoreceptor drum and then, as shown in FIG. 16, and a charging voltage in which DC power supply $P_{DC}$ and AC power supply $P_{AC}$ superimpose an AC voltage on a DC voltage is applied.

The core R1 of the rotational brush 2B has a radius of 2 mm. The diameter of the rotational brush is 15 mm and the rotation direction relative to the photoreceptor drum 1 of the rotational brush is the forward direction as shown in FIG. 18 (A).

Details of the brush member of this rotational brush 2B are shown below.

Brush fibers: Viscose rayon fibers containing 18 wt % conductive carbon. Diameter of 20 μm having a creased-shape surface. Electric resistance ratio of $10^6$ to $10^7$ Ωcm.

Pile: Formed by 100 said brush fibers harnessed together.

Base cloth: Comprised by polyester fibers.

The thrusting quantity towards the photoreceptor drum 1 of the pile of the rotational brush 2B is 1.5 mm.

Describing the schematic construction of this printer, it comprises the photoreceptor drum 1, and this drum is driven to rotate by a drive means (not shown in the figure) at a peripheral speed $V_D$ (surface movement speed) less than 100 mm/sec. On the periphery of the drum 1 is arranged, in addition to the charging device 2, a developing device 3, a transfer charger 4, a cleaning device 5 and an eraser 6 in this order. Above the photoreceptor drum 1, a print head unit 7 is arranged. This unit has a semiconductor laser generator device, a polygon mirror, a toroidal lens, a half mirror, a spherical mirror, a turning mirror and a reflex mirror arranged inside a housing 71. An exposure slit is formed on the bottom of this housing 71. Through this slit, the image on the photoreceptor drum 1 can be exposed through the area between the charging device 2 and the developing device 3. Further, the resolution is comparatively high and is set to 400 dpi.

At the right side of the photoreceptor drum 1 in the figure are arranged in order a pair of timing rollers 81, a pair of intermediate rollers 82 and a paper supply cassette 83. In the paper supply cassette 83 there is a paper supply roller 84. Further, at the left side of the photoreceptor drum 1 in the figure are arranged in order a pair of fixing rollers 91 and a pair of delivery rollers 92. A delivery tray 93 is facing the pair of delivery rollers 92.

Furthermore, although it is not shown in the figure, the paper supply portion in a paper supply cassette system is also provided at the lower portion to allow paper supply from the portion P1 in the figure, and a face-up tray is also connected to the portion P2 to allow discharge a sheet from the portion P2 in the figure.

The photoreceptor drum 1 is a functional separation type organic photoreceptor for a negative charge having a favorable sensitivity for long wavelength of semiconductors lasers (wavelength 780 nm) and LED light (wavelength 680 nm) as well as others. The drum is manufactured as described below.

At first, 1 part-by-weight τ type non-metallic phthalocyanine, 2 parts-by-weightpoly vinyl butyral resin and 100 parts-by-weight tetrahydrofuran are mixed in a ball mill pot and dispersed for 24 hours to obtain a photosensitive coating solution. The viscosity of the photosensitive coating solution during this time was 15 cp at 20° C. Moreover, for the poly vinyl butyral resin, acetylation degree was less than 3 mol %, butylation degree was 70 mol % and a degree of polymerization was 1000.

This coating solution was applied to the surface of cylindrical substrate (made of alumite) with an outside diameter of 30 mm, a length of 240 mm and a surface thickness of 0.8 mm by a dipping method, forming charge generating layer with a film thickness of 0.4 μm after drying. The cylindrical substrate used here was an aluminum alloy containing 0.7 percent-by-weight magnesium and 0.4 percent-by-weight silicon. The drying condition was a circulating air environment at 20° C. for approximately 30 minutes.

Next, 8 parts-by-weight hydrazone compound represented by the chemical formula below, 0.1 parts-by-weight orange element (Sumiplast Orange 12; Sumitomo Chemical) and 10 parts-by-weight polycarbonate resin (Panlite L-1250; Teijin Chemical) were dissolved in a liquid medium comprising 180 parts-by-weight tetrahydrofuran with the resulting solution applied to the surface of this charge generating layer using a dipping method and dried to form a charge transfer layer with a film thickness of 28 μm. The viscosity of the coating solution during this time was 240 cp at 20° C. The drying condition was a circulating air environment at 100° C. for 30 minutes.

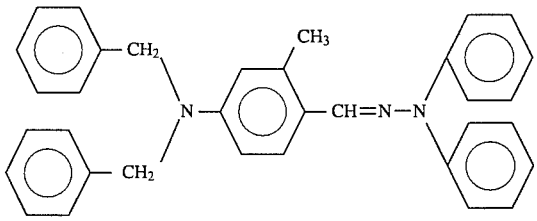

The functional separation type organic photoreceptor drum 1 for negative charging on which a charge generating layer and then charge transfer layer were formed on a conductive substrate was manufactured in this way.

The τ-type nonmetallic phthalocyanine used in the manufacture of the charge-generating layer has an X-ray diffraction pattern exhibiting strong peaks at Bragg angles (28±0.2 degrees) of 7.7, 9.2, 16.8, 17.4, 20.4, and 20.9 degrees when a Cu/Kα/Ni X-ray having a wavelength of 1.541 Å is used. In the infrared absorption spectrum, there are four absorption bands between 700~4760 $cm^{-1}$ which are most intense at 751±2 $cm^{-1}$, and two absorption bands between 1320~1340 $cm^{-1}$ which have nearly equal intensity of 3288±3 $cm^{-1}$.

The developing device 3 is a so-called mono-component developing device and performs reverse developing. The toner used is shown below.

The toner is a negative-charging non-transparent magnetic black toner comprising a mixture of 100 parts-by-weight (hereinafter "pbw") type-A bisphenol polyester resin, 5 pbw carbon black (MA#8; Mitsubishi Chemicals, Ltd.), 3 pbw charge control agent (Bontoron S-34; Orient Kagaku Kogyo K.K.), and 2.5 pbw wax (biscol TS-2050; Sanyo Kasei Kogyo K.K.), said mixture being kneaded, pulverized, and classified by well-known methods to produce toner particles having an 80% weight distribution within a range of 7~13 μm and a mean particle size of 10 μm. To these toner particles was added 0.75 percent-by-weight hydrophobic silica (Tullanox 500; Cabosil Co., Ltd.) as a fluidizing agent, and the materials were mixed using a homogenizer.

The developer and developing method used in the image forming apparatus of the present invention is not limited to those described above. Positive charging toner, transparent toner, magnetic toner, two-component developing method, standard developing method and the like may be suitably selected in accordance with the image forming process used, and polarity of the photosensitive member. Usable colors include not only black toner, but also yellow, magenta, cyan and the like color toners. The shape of the toner may be an indefinite shape, or a specific shape, e.g., spherical. A lubricant such as polyvinylidene fluoride may be added to improve cleaning characteristics.

The pile frequency fp (Hz) [fp=movement speed $V_B$ (mm/sec) of brush member 2B base cloth/pile pitch d (mm)] in the rotational brush member 2B of the charging device 2, frequency $f_{AC}$ (Hz) of the AC component applied to the brush member 2B and peripheral speed $V_D$ (mm/sec) of the photoreceptor drum 1 are set to satisfy condition $V_D=K|f_{AC}-f_p|(0<K\leqq 3)$ According to the printer described above, the surface of the photoreceptor drum 1 is uniformly charged to a fixed potential by the charging device 2, image exposure is carried out on this charged region from the print head unit 7 and an electrostatic latent image formed. The electrostatic latent image formed in this way is developed by the developing device 3 becoming a toner image and then transfers to the transfer region facing the transfer charger 4.

While, transfer paper is drawn from the paper supply cassette 83 by the pick-up roller 84 passing through the pair of intermediate rollers 82 reaching the pair of timing rollers 81 and at this point, synchronized with the toner image on the drum 1, the image is transferred to the transfer region. The transfer paper onto which a toner image on the drum i is transferred to the transfer paper by the function of the transfer charger 4 in the transfer region in this way reaches the pair of fixing rollers 91 with the toner image then being fixed. After this, the transfer paper is delivered to the discharge tray 93 by the pair of delivery rollers 92. After the toner image is transferred to the transfer paper, toner remaining on the photoreceptor drum 1 is cleaned by the cleaning device 5 and the remaining charge is removed by the eraser 6.

Next, a digital copying machine will be described which is another embodiment of the present invention with the main parts shown in FIG. 2.

Figure 2:
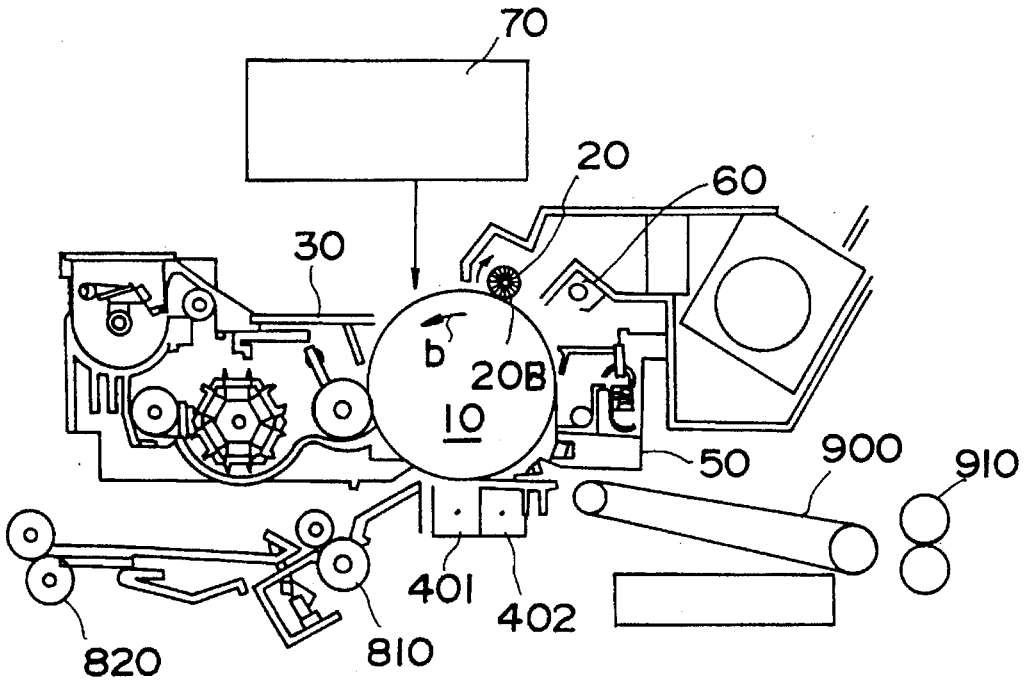
FIG. 2 shows a schematic construction of the main parts of the digital copying machine which is another embodiment of this invention.

The copying machine of FIG. 2 is an altered version of a comparatively high-speed digital copying machine model Di-30 manufactured by Minolta. As the device to charge the photoreceptor drum, a charging device 20 is utilized in which a brush member with a plurality of pile comprising brush fibers are implanted in a base material is made to rotate bringing this pile into contact with the surface of this photoreceptor drum, in place of the corona charging device in this copying machine model Di-30. This brush member is the type shown in FIG. 4 (A) and the weaving method of the pile P into the base cloth B1 is shown in FIG. 7 (E). This brush member is spirally wound on rotatable core R1 (manufactured with conductive metals) as shown in FIG. 8 (A) and then adhered using electrical adhesive agent to form rotational brush 20B. That pile is brought into contact with the photoreceptor drum as shown in FIG. 9 (A) and then, as shown in FIG. 16, a charging voltage is applied in which DC power supply $P_{DC}$ and AC power supply $P_{AC}$ superimpose an AC voltage on a DC voltage is applied.

The material, thickness, surface condition, electrical resistance ratio, pile construction and material of base cloth of the brush fibers in the brush 20B are identical to the charging rotational brush 2B in the printer of FIG. 1.

However, the core R1 of the rotational brush 20B has a radius of 3 mm and the diameter of the rotational brush is 17 mm. The rotation relationship with respect to the photoreceptor drum 10 of the rotational brush is the forward direction as shown in FIG. 18 (A) and the thrusting amount to the photoreceptor drum 10 of the rotational brush pile is 1.5 mm.

Describing the schematic construction of this copying machine, it comprises the photoreceptor drum 10. This drum is driven to rotate by a drive means (not shown in the figure) in the direction of arrow b at a peripheral speed $V_D$ of 100 mm/sec or more. On the periphery of the drum 10 is arranged, in addition to the charging device 20, a developing device 30, a transfer charger 401, a separation charger 402, a cleaning device 50 and an eraser 60 in this order.

Above the photoreceptor drum 10, an optical system 70 is arranged which includes a print head and image exposure of images on the photoreceptor drum 10 can be performed from here using laser light illuminating between the charging device 20 and the developing device 30. Further, the resolution is set to 600 dpi.

At the left side of the photoreceptor drum 10 in the figure, there are a pair of timing rollers 810 and a pair of intermediate rollers 820. Below these is a paper supply portion not shown in the figure. Further, at the right side of the photoreceptor drum 10 in the figure, there is transfer paper feed belt 900, a pair of fixing rollers 910 as well as a pair of discharge rollers and a discharge tray not shown in the figure.

The photoreceptor drum 10 is a functional separation type organic photoreceptor for a negative charge having a favorable sensitivity for light with long wavelength of semiconductors lasers (wavelength 780 nm) and LED light (wavelength 680 nm) like the photoreceptor drum 1 of the printer of FIG. 1. However, the photoreceptor base has an external diameter of 80 mm, a length of 350 mm and a wall thickness of 1 mm.

The developing device 30 is a two-component developing device using two-component developing agent comprising toner and carrier, and performs reverse developing. The toner used is identical to the toner used in the printer of FIG. 1. The carrier is as shown below.

The carrier used is a binder type with an undetermined shape and is manufactured as described below.

At first, 2 parts-by-weight carbon black (MA#8: Mitsubishi Kasei) and 300 parts-by-weight magnetic powder (MFP-2: TDK) are measured and added to 100 parts-by-weight polyester resin (Tafton NE1110: Kao) and then sufficiently mixed by a henschel mixer. The mixture thus obtained is sufficiently kneaded using a double shaft pusher and then after cooling, roughly ground. The rough particles are finely ground and classified by a crusher and a wind-force classifier to obtain fine polymer particles containing magnetic powder with an average grain size of 2 μm.

Next, said fine polymer particles containing 10 parts-by-weight magnetic powder are added to 100 parts-by-weight ferrite carrier (F-250HR average particle size 50 μm: Powder Tech) and processed for 40 minutes at 2500 rpm in an angmill (AM-20F Hosokawa Micron) to obtain an intermediate carrier with an average particle size of 55 μm. Further, using a suffusing system (Nippon Pneumatic MFG), this intermediate carrier undergoes heat processing at 400° C. to obtain the binder type carrier with an undetermined shape with a target average particle size of 55 μm.

This carrier is mixed with said toner at a weight ratio of 96:4 to obtain a two-component developing agent.

Moreover, there are no limitations on the carrier which can be used in the image forming apparatus related to the present invention. Corresponding to the polarity of the photoreceptor, the developing method and the toner used, a metal powder carrier or a resin coat carrier can be suitably chosen and used. Further, without using a powder type carrier, a developing system that employs functions required of a carrier to a conductive brush or a conductive roller may also be suitably chosen and used.

The pile frequency fp (Hz) [fp=moving speed $V_B$ (mm/sec) of brush member 20B base cloth / pile pitch d (mm)] in the rotational brush member 20B of the charging device 20, frequency $f_{AC}$ (Hz) of the AC component applied to the brush member 20B and peripheral speed $V_D$ (mm/sec) of the photoreceptor drum 10 are set to satisfy condition $$V_D=K|f_{AC}-fp|(0<K\leqq 3)$$

According to the copying machine of FIG. 2 described above, the surface of the photoreceptor drum 10 is uniformly charged to a fixed potential by the charging device 20, image exposure is carried out on this charged region from the optical system 70 and an electrostatic latent image formed. The electrostatic latent image formed in this way is developed by the developing device 30 becoming a toner image and then is moved to the transfer region facing the transfer charger 401.

While, transfer paper supplied from the paper supply portion not shown in the figure passes through the pair of intermediate rollers 820 reaching the pair of timing rollers 810 and at this point, synchronized with the toner image on the drum 10, the image is transferred to the transfer region. The transfer paper onto which a toner image on the drum 10 is transferred to the transfer paper by the function of the transfer charger 401 in the transfer region in this way is separated from the drum 10 by the separation charger 402 and then reaches the pair of fixing rollers 910 by the transfer feed belt 900 thereupon the toner image is fixed and then the paper is delivered. After the toner image is transferred to the transfer paper, toner remaining on the photoreceptor drum 10 is cleaned by the cleaning device 50 and the remaining charge is removed by the eraser 60.

In either of the image forming apparatus of FIG. 1 or FIG. 2, an image is formed as in a conventional apparatus. However, the charge on the surface of the photoreceptor drums 1, 10 prior to the formation of electrostatic latent image is carried out reliably by the rotational brush member making contact with said surface with the application of a charge voltage containing an AC component.

Figure 19:
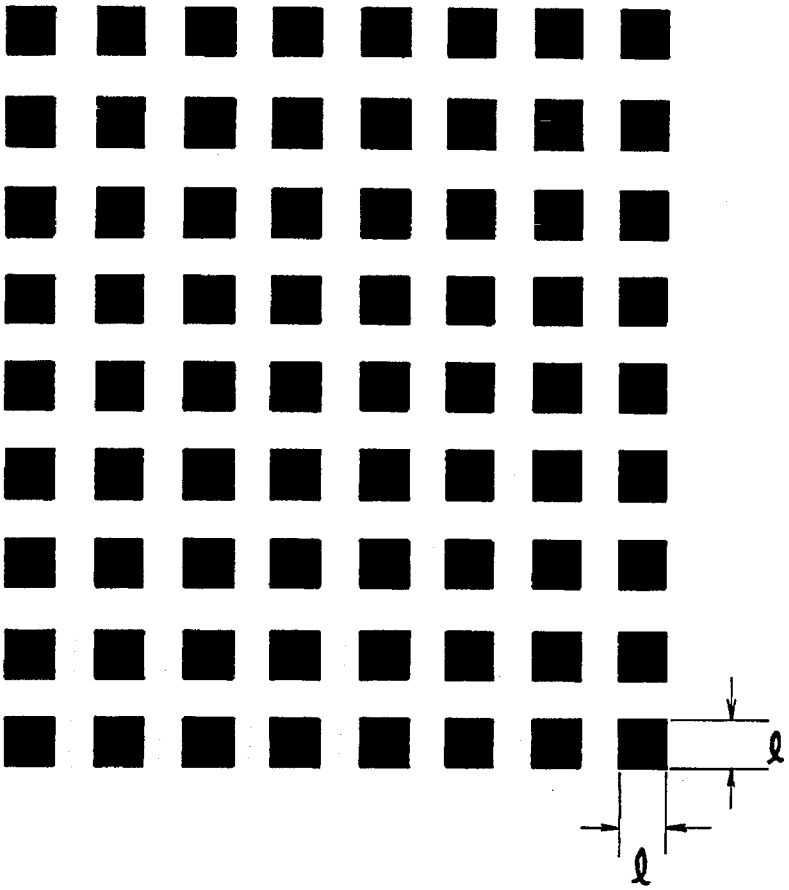
FIG. 19 shows an example of a shading pattern.
Figure 20:
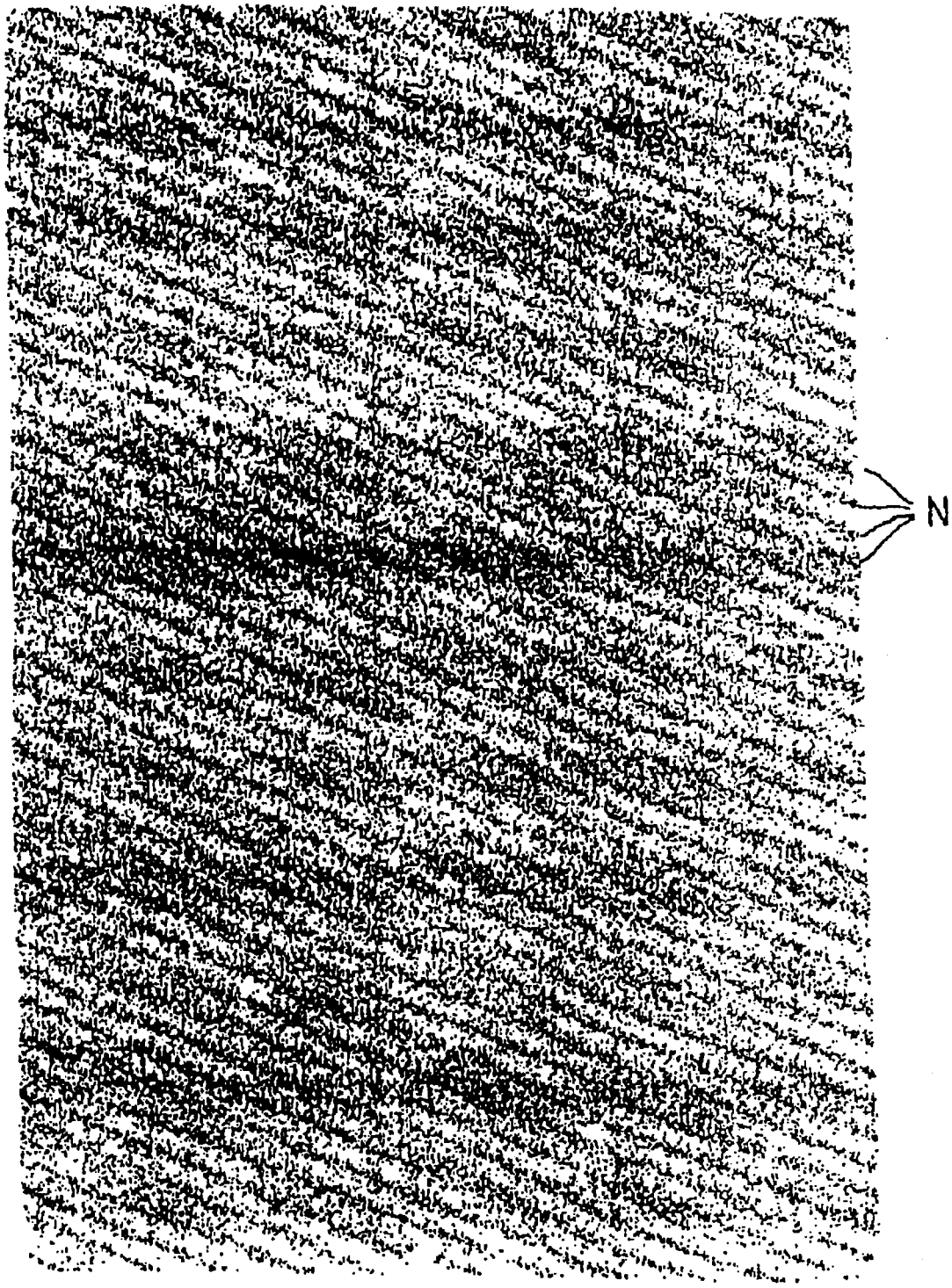
FIG. 20 shows an example of moire-shaped image noise.

Furthermore, because pile frequency fp (Hz) in the charging devices 2, 20 [fp=movement speed $V_B$ (mm/sec) of brush member base cloth] / pile pitch d (mm)], frequency $f_{AC}$ (Hz) of the AC component applied to the brush member and peripheral speed $V_D$ (mm/sec) of the photoreceptor drums 1, 10 are set to satisfy the condition $$V_D=K|f_{AC}-fP|(0<K\leqq 3)$$

moire-shaped image noise is suppressed to an almost non-existent state during practical use forming an image with the shading pattern (half pattern) as shown in FIG. 19.

Using the printer of FIG. 1 and the copying machine of FIG. 2 described above, an image was formed and an evaluation on whether or not moire-shaped noise was geneated. The evaluation results are shown in Table 1 and Table 2.

Figure 3:
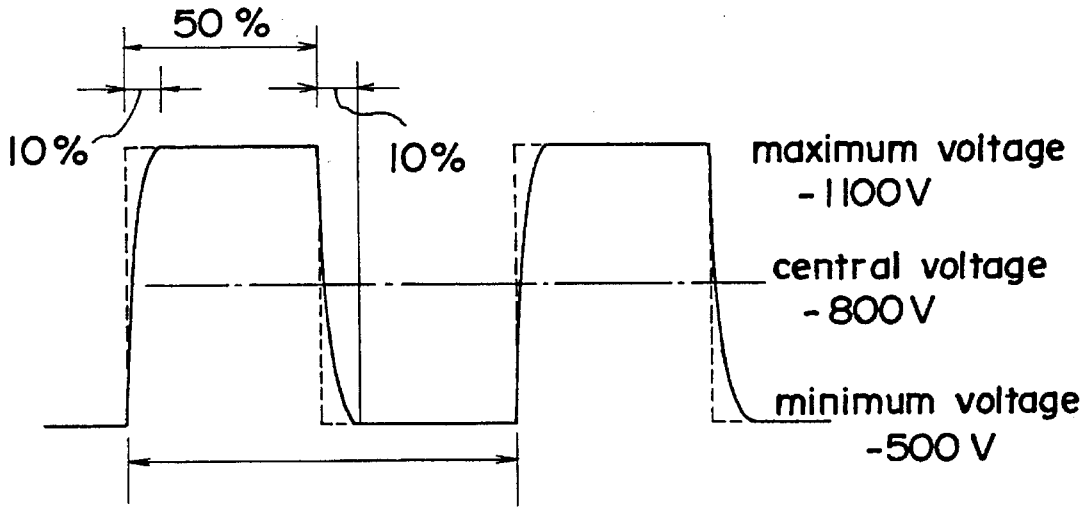
FIG. 3 shows the waveform of the AC component applied to the charging device.

For either of the image forming apparatus in this experiment, the AC component applied to the charging device 2, 20 has a maximum voltage of −1100 V, a minimum voltage of −500 V and a central voltage (−vi). As shown in FIG. 3, the waveform of the AC component is a 50% duty rectangular wave processed at a rising duty of 10% and a falling duty of 10%. Further, the developing bias voltage is −150 V.

In Table 1 and Table 2, "SP101" means the printer in FIG. 1 and "Di-30" means the copying machine in FIG. 2. Further, in the "Example" column at the left side, "E" means an experiment example this invention was applied to, "C" means a comparative experiment example without applicating this invention and the numbers in the ( ) are the experimental numbers.

Within these tables, in experiment groups α, β, and γ, relationship between the peripheral speed $V_D$ of the photoreceptor drum and constant K were investigated under conditions in which the pile pitch d of the charging device was changed. It was found that for practical use, there is no problem with K being a value of 3 or less and that a favorable image is obtained at a value of 2 or less.

Furthermore, experiment group δ in the table shows that the same results can be obtained even when the system speed (identical to peripheral speed $V_D$ of the photoreceptor drum) is fast. Experiment group η in the table shows that the same results can be obtained even though the frequency of the AC component is different from group α.

An image evaluation was further carried out pertaining to the moire-shaped noise as described next.

Although uneven image density due to moire is a visual function evaluation item, in this invention, uneven image density was made a numerical value using the method described below and an image evaluation made in correspondence with a visual function evaluation.

For the evaluation pattern, a 1-ON 1-OFF dot pattern as shown in FIG. 19 was formed on the entire surface of an A4 size paper and the generation state of moire-shaped noise was observed. Also, in the pattern of FIG. 19, the established length of one side of 1 dot at 600 dpi is 1=42.3 μm and at 400 dpi 1=63.5 μm.

Then the moire was converted to numeric values as described next. Namely, a 3 cm×3 cm region in the center of the A4 paper where the I-ON I-OFF dot pattern was formed was cut and then, using a densitometer (Sakura densitometer MODEL FDA-65: Konica) having a light receiving surface area with a diameter of 2 mm, the difference AID between the maximum ID (average value of 10 large values) and the minimum ID (average value of 10 small values) was measured with moving the light receiving surface up and down at an interval of 1 mm, and the result is made correspondance with the visual function evaluation as shown below.

$0.03<\Delta ID$ Unsuitable $0.01<\Delta ID\leqq 0.03$ No problem for practical use $\Delta ID\leqq 0.01$ Absolutely no problem Furthermore, the photoreceptor drum applicable to the present invention is not limited to the functional separation type organic photoreceptor having a favorable sensitivity for light with long wavelength of semiconductor lasers (wavelength 780 nm) and LED light (wavelength 680 rum) as stated in the previous embodiment.

For photosensitive region of the photoreceptor, a photoreceptor is applicable having a sensitivity with long wavelength as previously stated in an image forming system which uses light with long wavelength such as a semiconductor laser (wavelength 780 nm) optical system or an LED array (wavelength 680 nm) optical system. For example, a photoreceptor can be used having a sensitivity in the visible region in an image forming system using visible light as the light source including an LCD shutter array or a PLZT shutter array, an image forming system using visible laser light as the light source, an image forming system using a fluorescent light generating array as the light source or an analog image forming system using visible light commonly used in ordinary copying machines and a lens mirror optical system.

Furthermore, as for the construction of the photoreceptor, it can be a reverse laminated type of photoreceptor provided with a charge generation layer on top of the charge transport layer or a photoreceptor with a single layer construction having a combined charge generation function and charge transport function in addition to a functional separation type organic photoreceptor separately provided with a charge transport layer on top of the charge generation layer. Moreover, the charge generation material, charge transport material connecting resin and additional agents can also be suitably chosen from known materials according to the objective. In addition, the photosensitive material is also not restricted to an organic material. Inorganic materials such as zinc oxide, cadmium sulfide, selenium alloy, noncrystalline silicon alloy or noncrystalline germanium alloy.

A photoreceptor that can be applied to this invention can further be provided with a surface protection layer to improve the durability and environmental resistance properties as well as a lower layer to improve the charging performance, image quality and the adhesion characteristics toward substrate. The materials for this type of surface protection layer and lower layer can include resins such as infrared ray hardened resin, ordinary temperature hardened resin, heat hardened resin or a compound resin into which a resistance adjustment material is dispersed in the resin as well as vacuum thin film materials made from a metal oxide or a sulfur oxide and formed into a thin film in a vacuum using a deposition method or an ion plating method and undetermined shape carbon film created using a plasma polymer method or an undetermined shape silicon carbide film.

Even further, the substrate of the photoreceptor that can be applied to this invention is not restricted in any particular way if the photoreceptor support body has conductive surface. The shape can also be either a flat plate shape or a belt shape besides cylindrical shape. The surface of the substrate can have rough surface processing, oxidizing processing or coloring processing.

Although the present invention has been fully described by way of examples with reference to the accompanying drawings, it is to be understood that various changes and modifications will be apparent to those skilled in the art. Therefore, unless otherwise such changes and modifications depart from the scope of the present invention, they should be construed as being included therein.

TABLE 1

| | example | moving speed of base cloth (mm/sec) vB | pile pitch (mm) d | pile frequency (Hz) Fp | AC frequency (Hz) $F_{AC}$ | \|Fp − FAc\| = F | used machine | constant K | peripheral speed (mm/sec) vD | ΔID | evaluation |
|---|---|---|---|---|---|---|---|---|---|---|---|
| α | Ⓔ. C (1) | 70 | 1 | 70.0 | 50 | 20.0 | SP101 | 1.00 | 20 | 0.000 | suitable |
| | Ⓔ. C (2) | 70 | 1 | 70.0 | 50 | 20.0 | SP101 | 1.50 | 30 | 0.004 | suitable |
| | Ⓔ. C (3) | 70 | 1 | 70.0 | 50 | 20.0 | SP101 | 2.00 | 40 | 0.010 | suitable |
| | Ⓔ. C (4) | 70 | 1 | 70.0 | 50 | 20.0 | SP101 | 2.50 | 50 | 0.019 | no problem |
| | Ⓔ. C (5) | 70 | 1 | 70.0 | 50 | 20.0 | SP101 | 3.00 | 60 | 0.030 | no problem |
| | E. Ⓒ (1) | 70 | 1 | 70.0 | 50 | 20.0 | SP101 | 3.50 | 70 | 0.044 | unsuitable |
| β | Ⓔ. C (6) | 70 | 1.5 | 46.7 | 50 | 3.3 | SP101 | 1.52 | 5 | 0.004 | suitable |
| | Ⓔ. C (7) | 70 | 1.5 | 46.7 | 50 | 3.3 | SP101 | 2.12 | 7 | 0.012 | no problem |
| | E. Ⓒ (2) | 70 | 1.5 | 46.7 | 50 | 3.3 | SP101 | 3.03 | 10 | 0.031 | unsuitable |
| γ | Ⓔ. C (8) | 70 | 2 | 35.0 | 50 | 15.0 | SP101 | 0.67 | 10 | 0.001 | suitable |
| | Ⓔ. C (9) | 70 | 2 | 35.0 | 50 | 15.0 | SP101 | 1.33 | 20 | 0.002 | suitable |
| | Ⓔ. C (10) | 70 | 2 | 35.0 | 50 | 15.0 | SP101 | 2.00 | 30 | 0.010 | suitable |
| | Ⓔ. C (11) | 70 | 2 | 35.0 | 50 | 15.0 | SP101 | 2.67 | 40 | 0.022 | no problem |
| | E. Ⓒ (3) | 70 | 2 | 35.0 | 50 | 15.0 | SP101 | 3.33 | 50 | 0.039 | unsuitable |
| | E. Ⓒ (4) | 70 | 2 | 35.0 | 50 | 15.0 | SP101 | 4.00 | 60 | 0.060 | unsuitable |

TABLE 2

| | example | moving speed of vB | pile pitch (mm) d | pile frequency (Hz) Fp | AC frequency (Hz) $F_{AC}$ | \|Fp − FAc\| = F | used machine | constant K | peripheral speed (mm/sec) vD | ΔID | evaluation |
|---|---|---|---|---|---|---|---|---|---|---|---|
| δ | Ⓔ. C (12) | 150 | 1 | 150.0 | 50 | 100.0 | Di-30 | 1.00 | 100 | 0.000 | suitable |
| | Ⓔ. C (13) | 150 | 1 | 150.0 | 50 | 100.0 | Di-30 | 1.50 | 150 | 0.004 | suitable |
| | Ⓔ. C (14) | 150 | 1 | 150.0 | 50 | 100.0 | Di-30 | 2.00 | 200 | 0.010 | suitable |
| | Ⓔ. C (15) | 150 | 1 | 150.0 | 50 | 100.0 | Di-30 | 2.50 | 250 | 0.019 | no problem |
| | Ⓔ. C (16) | 150 | 1 | 150.0 | 50 | 100.0 | Di-30 | 3.00 | 300 | 0.030 | no problem |
| | E. Ⓒ (5) | 150 | 1 | 150.0 | 50 | 100.0 | Di-30 | 3.50 | 350 | 0.044 | unsuitable |
| η | Ⓔ. C (17) | 70 | 1 | 70.0 | 100 | 30.0 | SP101 | 1.83 | 55 | 0.008 | suitable |
| | Ⓔ. C (18) | 70 | 1 | 70.0 | 100 | 30.0 | SP101 | 2.00 | 60 | 0.010 | suitable |
| | Ⓔ. C (19) | 70 | 1 | 70.0 | 100 | 30.0 | SP101 | 2.17 | 65 | 0.013 | no problem |
| | Ⓔ. C (20) | 70 | 1 | 70.0 | 100 | 30.0 | SP101 | 2.33 | 70 | 0.015 | no problem |
| | Ⓔ. C (21) | 70 | 1 | 70.0 | 100 | 30.0 | SP101 | 2.50 | 75 | 0.019 | no problem |
| | Ⓔ. C (22) | 70 | 1 | 70.0 | 100 | 30.0 | SP101 | 2.67 | 80 | 0.022 | no problem |
| | Ⓔ. C (23) | 70 | 1 | 70.0 | 100 | 30.0 | SP101 | 2.83 | 85 | 0.026 | no problem |
| | Ⓔ. C (24) | 70 | 1 | 70.0 | 100 | 30.0 | SP101 | 3.00 | 90 | 0.030 | no problem |
| | E. Ⓒ (6) | 70 | 1 | 70.0 | 100 | 30.0 | SP101 | 3.17 | 95 | 0.034 | unsuitable |

What is claimed is:

1. An image forming apparatus comprising:

a rotatable photosensitive member;

a charging device for charging a surface of the photosensitive member prior to forming an electrophotographic latent image, the charging device including a rotatable brush member which is formed by implanting piles formed by brush fibers on a base member and provided in contact with the photosensitive member;

a power source for applying a charge voltage which includes at least AC component to said charging device, wherein said photosensitive member and charging device and power source are provided to satisfy the following condition:

$$V_D=K|f_{AC}-fP|(0<K\leqq 3),$$

wherein $V_D$ is a moving speed of the surface of said photosensitive member, K is a constant, $f_{AC}$ is frequency of the AC component and fp is a pile frequency which is represented by $V_B/d$, wherein $V_B$ is the moving speed of the base material and d is a pile pitch.

2. The image forming apparatus as claimed in claim 1, wherein the range of the constant K is $0<K\leqq 2$.

3. The image forming apprauts as claimed in claim 1, wherein an electrical resistance ratio of the brush fiber is set to a volume resistivity of about $10^9$ Ωcm or less.

4. The image forming apprauts as claimed in claim 3, wherein an electrical resistance ratio of the brush fiber is set to a volume resistivity of $10^7$ Ωcm or less.

5. An image forming apparatus comprising a rotatable photosensitive member, a charging device for charging a surface of the photosensitive member prior to forming an electrophotographic latent image and including a rotatable brush member formed by implanting piles with brush fibers on a base member so as to be in contact with the photosensitive member, and a power source for applying a charge voltage which includes at least AC component to said charging device, the image forming apparatus being characterized in satisfying the following condition:

$$V_D=K|f_{AC}-V_B/d|(0<K\leqq 3),$$

wherein $V_D$ is a moving speed of the surface of said photosensitive member, K is a constant, $f_{AC}$ is frequency of the AC component, $V_B$ is the moving speed of the base material and d is a pile pitch.

6. The image forming apparatus as claimed in claim 5, wherein the range of the constant K is $0<K\leqq 2$.

* * * * *